US011271311B2

(12) United States Patent
Chiu et al.

(10) Patent No.: US 11,271,311 B2
(45) **Date of Patent: *Mar. 8, 2022**

(54) COMPACT WIDEBAND INTEGRATED THREE-BROADSIDE-MODE PATCH ANTENNA

(71) Applicant: The Hong Kong University of Science and Technology, Hong Kong (CN)

(72) Inventors: Chi Yuk Chiu, Hong Kong (CN); Ross David Murch, Hong Kong (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/064,266

(22) Filed: Oct. 6, 2020

(65) Prior Publication Data

US 2021/0021041 A1 Jan. 21, 2021

Related U.S. Application Data

(63) Continuation-in-part of application No. 16/220,916, filed on Dec. 14, 2018, now Pat. No. 10,854,977.

(60) Provisional application No. 62/973,720, filed on Oct. 22, 2019, provisional application No. 62/708,755, filed on Dec. 21, 2017.

(51) Int. Cl.

| | |
|---|---|
| ***H01Q 9/04*** | (2006.01) |
| ***H01Q 21/06*** | (2006.01) |
| ***H01Q 5/50*** | (2015.01) |
| ***H01Q 5/15*** | (2015.01) |

(52) U.S. Cl.
CPC ..... *H01Q 9/0407* (2013.01); *H01Q 5/15* (2015.01); *H01Q 5/50* (2015.01); *H01Q 21/065* (2013.01)

(58) Field of Classification Search
CPC ..... H01Q 9/0407; H01Q 5/15; H01Q 5/50; H01Q 21/065; H01Q 21/24; H01Q 21/28
See application file for complete search history.

(56) References Cited

U.S. PATENT DOCUMENTS

| | | | | |
|---|---|---|---|---|
| 4,410,891 A | | 10/1983 | Schaubert et al. | |
| 5,307,075 A | | 4/1994 | Huynh | |
| 5,880,694 A | * | 3/1999 | Wang | H01Q 5/378 343/700 MS |

(Continued)

FOREIGN PATENT DOCUMENTS

TW 201731162 A 9/2017

OTHER PUBLICATIONS

Ko et al., "Compact Integrated Diversity Antenna for Wireless Communications", *IEEE Transactions on Antennas and Propagation*, 49(6): 954-960 (2001).

(Continued)

*Primary Examiner* — Hoang V Nguyen
(74) *Attorney, Agent, or Firm* — Leydig, Voit & Mayer, Ltd.

(57) ABSTRACT

A three-broadside-mode patch antenna includes: a rotationally symmetric radiator; a patch, wherein the patch is separated from the rotationally symmetric radiator by a dielectric and configured to capacitively feed the rotationally symmetric radiator; and three antenna probes, connected to the patch, configured to provide three antenna ports corresponding to three respective broadside radiation polarizations.

21 Claims, 27 Drawing Sheets

(56) References Cited

U.S. PATENT DOCUMENTS

| | | | |
|---|---|---|---|
| 5,945,950 | A | 8/1999 | Elbadawy |
| 6,310,584 | B1 | 10/2001 | Reece et al. |
| 6,717,549 | B2 | 4/2004 | Rawnick et al. |
| 6,897,808 | B1 | 5/2005 | Murch et al. |
| 6,975,278 | B2 | 12/2005 | Song et al. |
| 7,629,930 | B2 | 12/2009 | Murch et al. |
| 7,973,718 | B2 | 7/2011 | Mak et al. |
| 8,547,289 | B2 | 10/2013 | Montgomery et al. |
| 8,643,562 | B2 | 2/2014 | Chang et al. |
| 8,659,498 | B2 | 2/2014 | Rothwell |
| 2003/0122712 | A1 | 7/2003 | Rawnick et al. |
| 2005/0116862 | A1 | 6/2005 | du Toit |
| 2005/0190106 | A1 | 9/2005 | Anguera Pros et al. |
| 2007/0097007 | A1 | 5/2007 | Milyakh |
| 2007/0176829 | A1 | 8/2007 | Liu |
| 2007/0279286 | A1 | 12/2007 | Coutts et al. |
| 2008/0100530 | A1 | 5/2008 | Manholm et al. |
| 2008/0136734 | A1 | 6/2008 | Manholm et al. |
| 2009/0128413 | A1* | 5/2009 | Crouch ..... H01Q 3/26 343/700 MS |
| 2011/0032154 | A1 | 2/2011 | Chung et al. |
| 2011/0111783 | A1 | 5/2011 | Chayat |
| 2011/0279339 | A1 | 11/2011 | Johnston |
| 2013/0072136 | A1 | 3/2013 | Besoli et al. |
| 2013/0113673 | A1 | 5/2013 | Kyria |
| 2013/0321240 | A1 | 12/2013 | O'Shea et al. |
| 2015/0077299 | A1 | 3/2015 | Tatarnikov et al. |
| 2015/0194730 | A1 | 7/2015 | Sudo et al. |
| 2019/0123456 | A1 | 4/2019 | Ming et al. |
| 2019/0198998 | A1 | 6/2019 | Chiu et al. |

OTHER PUBLICATIONS

Manteuffel et al., "Compact Multimode Multielement Antenna for Indoor UWB Massive MIMO," *IEEE Trans. Antennas Propagat.*, 64(7): 2689-2697 (Jul. 2016).

Rusek, et al.. "Scaling up MIMO: Opportunities and Challenges with Very Large Arrays," *IEEE Signal Process. Mag.*, 30(1): 40-60 (2013).

Larsson, E., et al., "Massive MIMO for Next Generation Wireless Systems," *IEEE Commun. Mag.*,52(2): 186-195 (1994).

Lu et al., "An Overview of Massive MIMO: Benefits and Challenges," *IEEE J. Sel. Topics in Signal Process.*, 8(5): 742-758 (2014).

Chiu et al., "Design and Implementation of a Compact 6-Port Antenna," *IEEE Antennas Wireless Propag. Lett.*, vol. 8, pp. 767-770, 2009.

Chen et al., "A Dual-Mode Wideband MIMO Cube Antenna with Magneto-Electric Dipoles," *IEEE Trans. Antennas Propag.*, 62(12): 5951-5959 (2014).

Moradikordalivand et al., "Common Elements Wideband MIMO Antenna System for WiFi/LTE Access-Point Applications," *IEEE Antennas Wireless Propag. Lett.*, 13: 1601-1604 (2014).

Stein, "On Cross Coupling in Multiple-Beam Antennas," *IRE Trans. Antennas Propag.*, 10(5): 548-557 (Sep. 1962).

Chiou et al., "Broad-Band Dual-Polarized Single Microstrip Patch Antenna with High Isolation and Low Cross Polarization," *IEEE Trans. Antennas Propag.*, 50(3), 399-401 (2002).

Chen et al., "Experimental Study on Radiation Performance of Probe-Fed Suspended Plate Antennas." *IEEE Trans. Antennas Propag.*, 51(8): 1964-1971 (2003).

Sim et al., "Dual-feed dual-polarized patch antenna with low cross polarization and high isolation," *IEEE Trans. Antennas Propag.*, 57(10): 3405-3409 (2009).

Pinchera et al., "A dual-polarized parasitic patch antenna for MIMO systems," *in Proc. 39th Europ. Microw. Conf.* (*EuMC*), *Rome, Italy*, Sep. 29-Oct. 1, 2009, 642-644.

Gao et al., "Stacked Patch Antenna with Dual-Polarization and Low Mutual Coupling for Massive MIMO," *IEEE Trans. Antennas Propag.*, 64(10): 4544-4549 (2016).

Wu et al., "A Novel Design of Dual Circularly Polarized Antenna Fed by L-Strip," *Progress In Electromagnetics Research* (*PIER*), 79: 39-46 (2008).

Harouni et al., "A Dual Circularly Polarized 2.45-GHz Rectenna for Wireless Transmission," *IEEE Antennas Wireless Propag. Lett.*, 10: 306-309 (2011).

Chou et al., "Novel t-Shape Slot Couple Feed Dual Circular Polarized Rectenna," *in Proc. Int. Symposium Antennas Propag.* (*ISAP*), *Nagoya, Japan*, Oct. 29-Nov. 2, 2012, 178-181.

Tsai et al., "Reconfiguarable Square-Ring Microstrip Antenna," *IEEE Trans. Antennas Propag.*, 61(5): 2857-2860 (2013).

Kim et al., "A Novel Single-Feed Circular Microstrip Antenna with Reconfigurable Polarization Capability," *IEEE Trans. Antennas Propag.*, 56(3): 630-638 (2008).

Wu et al., "Wideband Tri-Polarization Reconfigurable Magneto-Electric Dipole Antenna," *IEEE Trans. Antennas Propag.*, 65(4): 1633-1641 (2017).

Chiu et al., "Compact Three-Port Orthogonally Polarized MIMO Antennas," *IEEE Antennas Wireless Propag. Lett.*, vol. 6, pp. 619-622, 2007.

Garbacz, "Modal Expansions for Resonance Scattering Phenomena," *Proc. IEEE*, 53(8): 856-864 (1965).

Garbacz et al., "A Generalized Expansion for Radiated and Scattered Fields," *IEEE Trans. on Antennas Propag.*, 19(3) 348-358 (1971).

Harrington et al., "Theory of Characteristic Modes for Conducting Bodies," *IEEE Trans. Antennas Propag.*, 19(5):622-628 (1971).

Harrington, "Computation of Characteristic Modes for Conducting Bodies," *IEEE Trans. Antennas Propag.*, 19(5):629-639 (1971).

Tian et al., "Multiplexing Efficiency of MIMO Antennas," *IEEE Antennas Wireless Propag. Lett.*, 10:183-186 (2011).

Safin et al., "Reconstruction of the Characteristic Modes on an Antenna Based on the Radiated Far Field," *IEEE Trans. Antennas Propag.*, 61(6): 2964-2971 (2013).

CST Microwave Studio, CST Studio Suite TM, (2017).

Feko 14.0, Altair Engineering Inc., (2016).

Tian, et al., "A Compact Six-Port Dielectric Resonator Antenna Array: MIMO Channel Measurements and Performance Analysis," *IEEE Trans. Antennas Propag.*, 58(4): 1369-1379, (2010).

Lee at al., "Characteristics of the Equilateral Triangular Patch Antenna," *IEEE Transactions on Antennas and Propagation*, 36(11), pp. 1510-1518, (1988).

Zhu et al., "A Compact Tri-Band Monopole Antenna With Single-Cell Metamaterial Loading," *IEEE Transactions on Antennas and Propagation*, 58(4), pp. 1031-1038, (2010).

U.S. Appl. No. 16/220,916, filed Dec. 14, 2018.

Alibakhshikenari, M., et al. "Wideband Sub-6 GHz Self-Grounded Bow-Tie Antenna with New Feeding Mechanism for 5G Communications Systems", 13$^{th}$ *European Conference on Antennas and Propagation* (EuCAP 2019), 4 pages total.

Saxena, S., et al., "MIMO Antenna with Built-in-Circular Shaped Isolator for sub-6 GHz 5G Applications", *Electronics Letters*, vol. 54, No. 8, pp. 478-180, (Apr. 19, 2018).

Li, Qian, et al., "Flexible Extensible Planar Self-Isolated Wideband MIMO Antenna for 5G Communications", *Electronics*, vol. 8, 994, pp. 1-12 (2019).

Kumar, Sachin, et al., "A Compact Four-Port UWB MIMO Antenna with Connected Ground and Wide Axial Ratio Bandwidth", *Interntional Journal of Microwave and Wireless Technologies*, Cambridge Core, pp. 1-11 (Nov. 7, 2019).

Piao, Dazhi, et al., "Experimental Evaluation of the Tri-Polarized MIMO Channel Properties Based on a Compact Multimode Antenna", *IEEE Access*, vol. 7, pp. 67807-67817, (2019).

Chiu, Chi-Yik, et al., "Bandwidth Enhancement Technique for Broadside Tri-Modal Patch Antenna", *IEEE Open Journal of Antennas and Propagation*, pp. 1-10 (2020).

* cited by examiner (a)

(b)

(c)

(a)

(b)

(a)

(b)

(a)

(b)

COMPACT WIDEBAND INTEGRATED THREE-BROADSIDE-MODE PATCH ANTENNA

CROSS-REFERENCE TO RELATED APPLICATIONS

This patent application is a continuation-in-part of copending U.S. patent application Ser. No. 16/220,916, filed Dec. 14, 2018, which claims the benefit of U.S. Provisional Patent Application No. 62/708,755, filed Dec. 21, 2017. This patent application also claims the benefit of U.S. Provisional Patent Application No. 62/973,720, filed Oct. 22, 2019. All of the foregoing patent applications are incorporated herein by reference in their entireties.

BACKGROUND

A promising 5th generation (5G) technology for base stations is to use massive multiple-input multiple-output (MIMO) to increase data throughput and serve more devices simultaneously. Massive MIMO uses a large number of small antennas to create more possible signal paths to improve data rate and link reliability. If a line-of-sight (LoS) propagation environment is considered, more directive antenna elements can provide better spectrum efficiency and reduce the associated radiated power. Usually, the number of antenna ports in massive MIMO corresponds to a couple of hundreds or more. In order to make massive MIMO antennas more compact, or to build more radiating elements in a specific area, multi-mode antennas may be considered.

Various multi-mode antennas have been proposed over the past few decades. The most fundamental and classical example is a square patch fed by two coaxial probes creating vertical and horizontal polarized radiations simultaneously. Separated parasitic or connected patches can also be added next to a driven radiating element providing dual-polarized radiations. A feeding mechanism such as dual-feed or single-feed with a switching element like a diode or a micro electro mechanical switch (MEMS) are commonly used in dual-mode antennas. Apart from vertical and horizontal linear polarizations, left-hand and right-hand circular polarizations (LHCP and RHCP) can also be realized. A compact integrated Y-shaped patch antenna can also be used to generate two-broadside-mode radiations by choosing proper locations for two coaxial feeds. In general, a two-mode antenna with broadside radiation patterns is easy to achieve due to the inherent two orthogonal polarizations.

A compact antenna beyond two modes is difficult to implement owing to high and complicated mutual coupling between antenna ports. Various decoupling techniques have been proposed and developed to suppress ports mutual coupling, such as inserting a defected ground structure, a scattering element, a decoupling network, etc. Another example shows that three monopole antennas can be arranged to produce three sectorized radiation patterns in azimuth plane. Nevertheless, a practical and compact beyond-two-broadside-mode antenna using such conventional technologies has not been achieved.

SUMMARY

In an exemplary embodiment, the invention provides a three-broadside-mode patch antenna. The three-broadside-mode patch antenna includes: a rotationally symmetric radiator; a patch, wherein the patch is separated from the rotationally symmetric radiator by a dielectric and configured to capacitively feed the rotationally symmetric radiator; and three antenna probes, connected to the patch, configured to provide three antenna ports corresponding to three respective broadside radiation polarizations.

In another exemplary embodiment, the invention provides a massive-input massive-output (MIMO) antenna. The MIMO antenna includes: a plurality of three-broadside-mode patch antenna cells. Each of the plurality of three-broadside-mode patch antenna cells includes: a rotationally symmetric radiator; a patch, wherein the patch is separated from the rotationally symmetric radiator by a dielectric and configured to capacitively feed the rotationally symmetric radiator; and three antenna probes, connected to the patch, configured to provide three antenna ports corresponding to three respective broadside radiation polarizations.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1A:
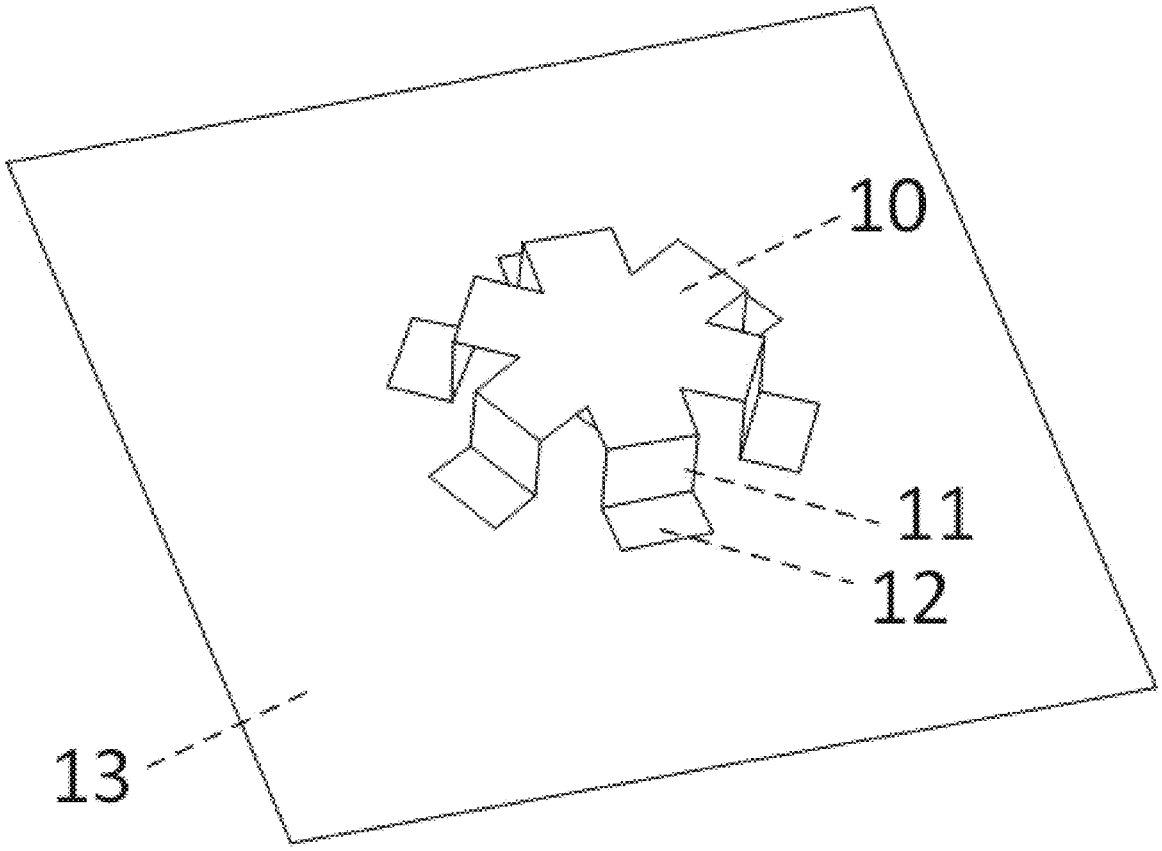
FIGS. 1(*a*)-1(*d*) show a structure of a compact 3-broadside-mode patch antenna according to an exemplary embodiment (including: (a) a first perspective view, (b) a second perspective view without a top portion of the patch radiator, (c) a third perspective view without a top portion of the patch radiator and further without two legs of the patch radiator; and (d) exemplary dimensions (in mm) of certain elements depicted in FIGS. 1(*a*)-(*c*))
Figure 1B:
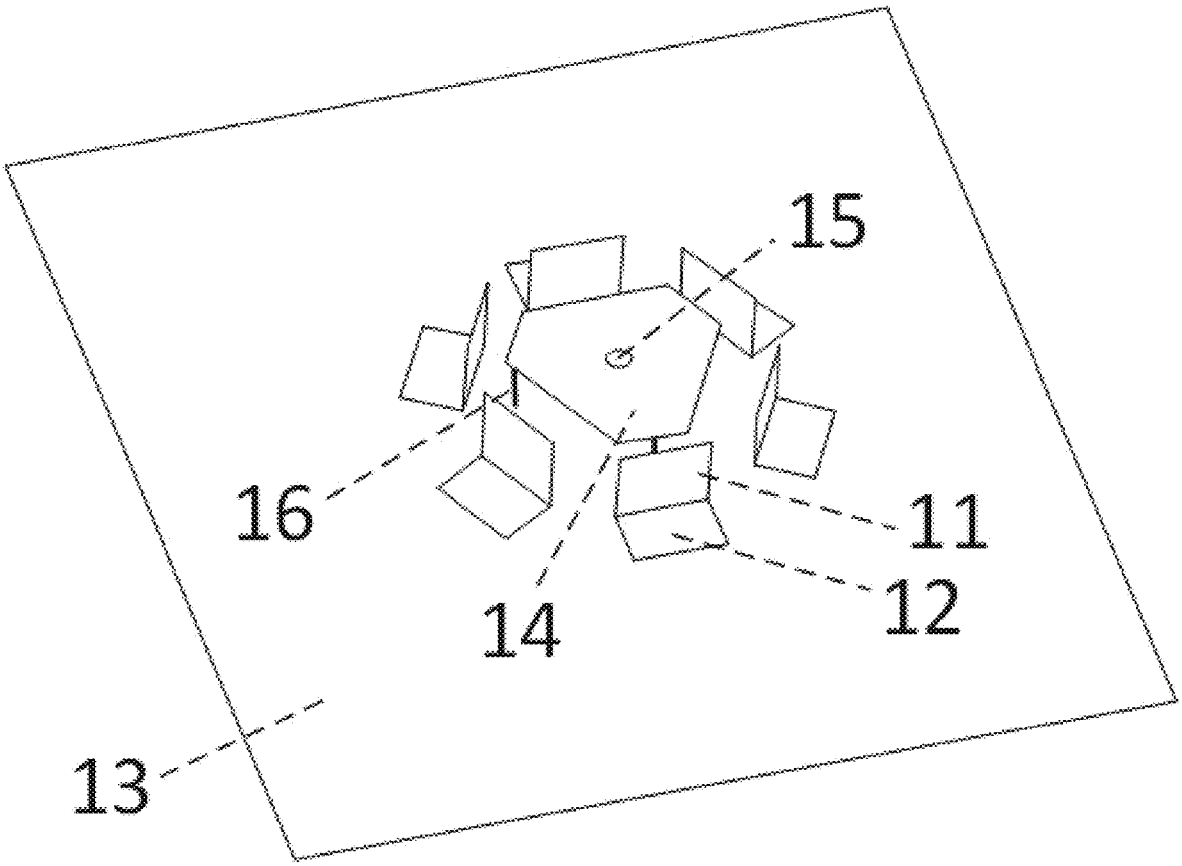
Figure 1C:
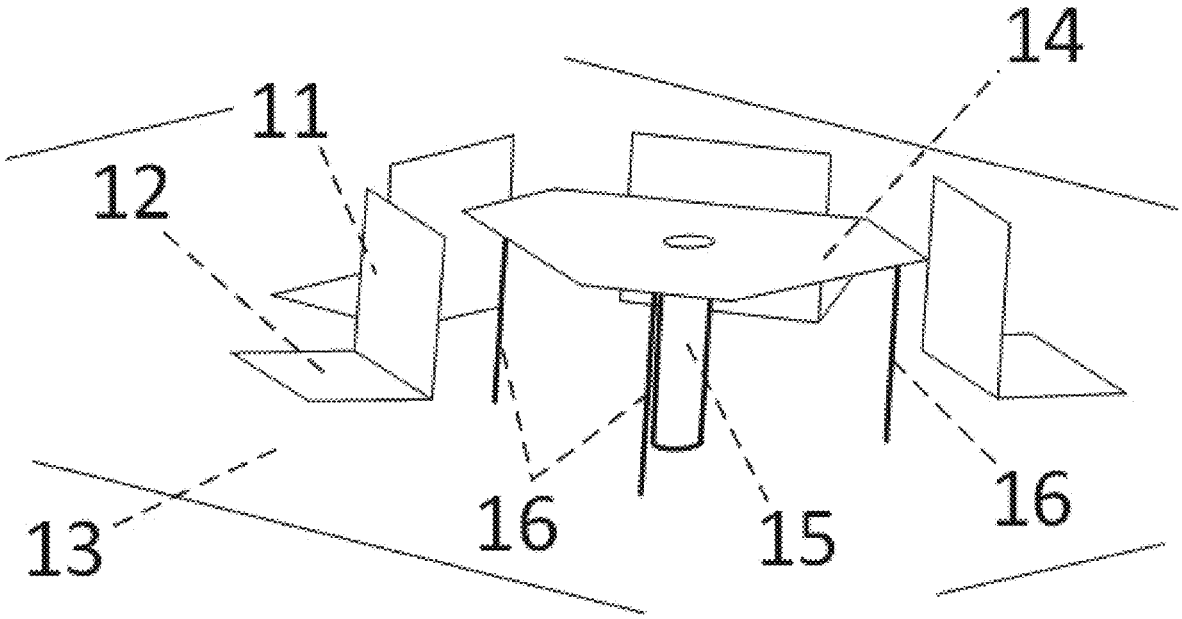
Figure 1D:
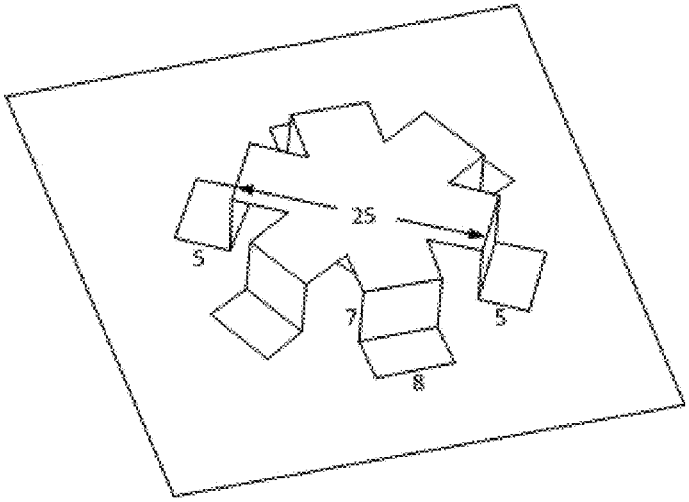
Figure 1D:
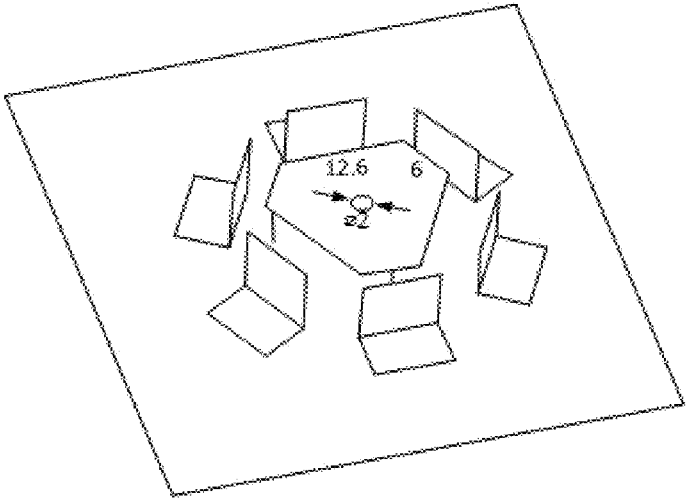
Figure 1D:
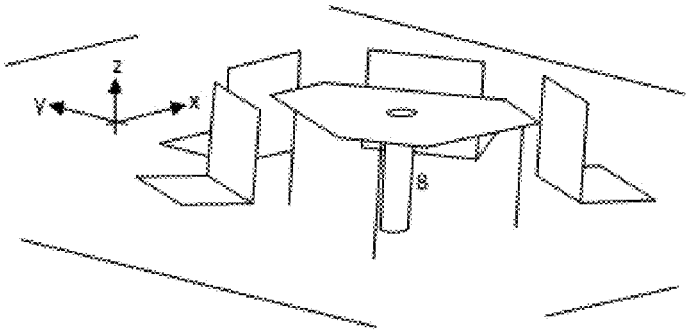

A conventional patch antenna only exhibits two broadside mode radiations which are usually referred to as vertical and horizontal polarizations. Exemplary embodiments of the present application, however, provide a compact three-broadside-mode patch antenna having three broadside mode radiations (e.g., corresponding to 0, 120 and 240 degrees).

Exemplary embodiments of the present application provide an integrated structure of three patch antennas (i.e., a three-broadside-mode patch antenna or "3-port antenna"), wherein all antenna ports have broadside radiation patterns and exhibit low mutual coupling. The three-broadside-mode patch antenna provides low mutual coupling between three antenna ports and provides three broadside radiation patterns. The three-broadside-mode patch antenna may be compact in size.

In a first exemplary implementation, a snowflake-shaped radiator with a side length of 35 mm, corresponding to $0.33\lambda_0$ ($\lambda_0$ is the wavelength in a vacuum), and having one shorting pin at the center of a hexagonal patch, corresponding to a resonant frequency of 2.8 GHz, is able to accommodate three antenna ports resonated at the same frequency. In a second exemplary implementation, a snowflake-shaped radiator with a side length of 35 mm, corresponding to $0.36\lambda_0$ ($\lambda_0$ is the wavelength in a vacuum), and having three shorting pins evenly distributed next to three probes, corresponding to a resonant frequency of 3.05 GHz, is able to accommodate three antenna ports resonated at the same frequency.

In an exemplary implementation, according to both simulation and experimental results (which were consistent with one another), mutual coupling nulls (corresponding to local minima in a frequency response plot) were found and coincided with the resonant frequency of the antenna ports, indicating low mutual coupling at the resonant frequency.

For better impedance matching, three coaxial probes are connected to a common hexagonal patch which is used to capacitively feed the snowflake-shaped radiator on top. The common hexagonal patch is excited by the three coaxial probes simultaneously to capacitively feed the snowflake-shaped radiator. There is no physical connection between the probes and the snowflake-shaped radiator, as the snowflake-shaped radiator is suspended above the common hexagonal patch (e.g., by being separated from the common hexagonal patch by a dielectric such as polyethylene terephthalate (PET), paper, wood or Styrofoam).

Each of the six legs of the snowflake-shaped radiator may have two folds to form a first portion perpendicular to the ground plane and a second portion parallel to the ground plane. It will be appreciated that the six legs may all be integrally formed as part of the radiator (e.g., each leg is part of an integral piece of material that has six folds), or that the six legs may be formed of separate materials attached together (e.g., each leg may include a piece of material having one fold being attached to a snowflake-shaped radiator). The separation of the radiator from the patch and the folded shape of the legs provides a capacitive loading effect leading to miniaturization of the entire three-broadside-mode patch antenna.

Since the three antenna ports of the three-broadside-mode patch antenna according to an exemplary embodiment have a 120-degree rotational symmetry, the characteristics of the three antenna ports may be identical (e.g., the three antenna ports exhibit rotationally symmetric radiation characteristics such that antenna gain, efficiency, radiation pattern, impedance bandwidth, impedance matching, and mutual coupling may be the same).

When a hexagonal ground plane (which corresponds to the six-legged shape of the snowflake-shaped radiator) is used, the three-broadside-mode patch antenna may be used as a building block for building a massive multiple-input multiple-output (MIMO) antenna, since the hexagonal ground planes of adjacent antennas will fit together in a honeycomb structure. All radiating elements within the massive MIMO antenna can produce broadside radiations. Since each three-broadside-mode patch antenna has three antenna ports, with each antenna port producing one broadside mode radiation, a 50% increase in antenna ports is achieved relative to that of a massive MIMO antenna which is constructed by conventional half-wavelength dual-polarized patch antennas. Further, the use of a snowflake-shaped radiator which provides a modal radiation pattern supporting 3 nearly orthogonal pattern vectors allows for the third polarization to be achieved with low mutual coupling, allowing exemplary embodiments of the three-broadside-mode patch antenna to be usable in practice.

It will be appreciated that special materials and special manufacturing processes are not required to implement exemplary embodiments of the compact 3-broadside-mode patch antenna discussed herein. As with other efficient antennas, high conducting metals (having low resistivity) may be used. Further, it will be appreciated that a SubMiniature version A (SMA) connector may be used as the interface at the backside of the ground plane for testing exemplary implementations of the compact 3-broadside-mode patch antenna.

FIGS. 1(*a*)-1(*c*) show a structure of a compact 3-broadside-mode patch antenna according to an exemplary embodiment.

FIG. 1(*a*) shows a first perspective view of the compact 3-port antenna. The antenna includes a radiator 10 (the depicted radiator 10 is a snowflake-shaped patch radiator) which may be made of metal (e.g., copper or aluminum) and may be held up in the air by separating the radiator 10 from a patch of the antenna using a dielectric. The six legs of the radiator 10 each include a first portion 11 and a second portion 12. For example, as depicted in FIG. 1(*a*), the first portion 11 may be upright and the second portion 12 may be flat, such that each of the six legs of the snowflake-shaped radiator may have two folds, with the first portion 11 perpendicular to the ground plane and the second portion 12 parallel to the ground plane. The ground plane 13 may also be made of metal (e.g., copper or aluminum).

The second portion 12 of each leg does not have any physical connection with the ground plane 13 and thus provides a capacitive loading effect for the antenna. For a capacitor constructed of two parallel plates separated by a distance, capacitance is proportional to the area of overlap and inversely proportional to the separation between conducting sheets. With the folded structure of FIG. 1(*a*) where multiple second portions 12 are close to the ground plane, the radiator 10 provides capacitive loading which alters the antenna input impedance in a way that provides a shorter resonance length. This allows for antenna miniaturization to be realized.

It will be appreciated that the ground plane 13 may be rectangular, circular, hexagonal or any other shape. However, in certain exemplary embodiments, when multiple antennas are jointed together (e.g., to form a massive MIMO antenna), certain shapes (e.g., hexagonal) may be advantageous due to being able to symmetrically join multiple antennas together.

FIG. 1(*b*) shows a second perspective view of the compact 3-port antenna without a top portion of the patch radiator (i.e., a top portion of the radiator 10 from FIG. 1(*a*) is removed to show other elements of the antenna). The six legs of the radiator and the ground plane 13 remain the same as shown in FIG. 1(*a*). Under the top portion of the patch radiator, there is a hexagonal patch 14 supported by a shorting pin 15 and three antenna probes 16. The hexagonal patch 14 works as a noncontact (or "capacitive") feeding mechanism. By changing the area of the feed plate (hexagonal patch), the separation from the radiating top plate, and probe placement on the feed plate, the resonance properties of the antenna may be controlled, which provides more design flexibility relative to direct feed mechanisms. The shorting pin 15 is connected to both the hexagonal patch 14 and the ground plane 13, and the shorting pin alters the current distribution of the hexagonal patch which changes the antenna input impedance. The hexagonal patch 14 and the shorting pin 15 are both made of metal (e.g., copper), and may be attached via soldering. The shorting pin 15 is located at the center of the hexagonal patch 14, and the three antenna probes 16 are evenly distributed around the hexagonal patch 14. The three antenna probes 16 correspond to three antenna ports used to excite the hexagonal patch 14, which in turn capacitively feeds the radiator 10. The other end of the antenna probes 16 may be, for example, connected to an SMA connector interface. The even distribution of the three antenna probes 16 provides for identical antenna properties (except for their different polarizations) for the three antenna ports and also provides 120-degree rotational symmetry.

As discussed above, there is no physical connection between the radiator 10 and the hexagonal patch 14, which provides for a capacitive feeding effect.

FIG. 1(*c*) shows a third perspective view of the compact 3-port antenna without the top-side patch radiator and further without two legs of the antenna. As can be seen in this figure, the shorting pin 15 is connected to the ground plane 13 and the hexagonal patch 14. And as discussed above, the three antenna probes 16 are evenly distributed around the hexagonal patch 14.

FIG. 1(*d*) shows exemplary dimensions (in mm) of certain elements depicted in FIGS. 1(*a*)-1(*c*) for a compact 3-port antenna that resonates at 2.8 GHz. Part (a) of FIG. 1(*d*) shows that the largest lateral dimension of the snowflake-shaped radiator is 5 mm+25 mm+5 mm (35 mm), corresponding to $0.33\lambda_0$. The height of the first portion of each leg is 7 mm, and the width of each leg is 8 mm. Part (b) of FIG. 1(*d*) shows that the hexagonal patch may have side lengths of 12.6 mm and 6 mm, and Part (c) of FIG. 1(*d*) shows that the height of the shorting pin is 8 mm. Additionally, there is 1 mm of separation between the snowflake-shaped radiator and the patch (e.g., via a dielectric such as air). It will be appreciated that other exemplary implementations may utilize other respective dimensions and other resonant frequencies.

Figure 2:
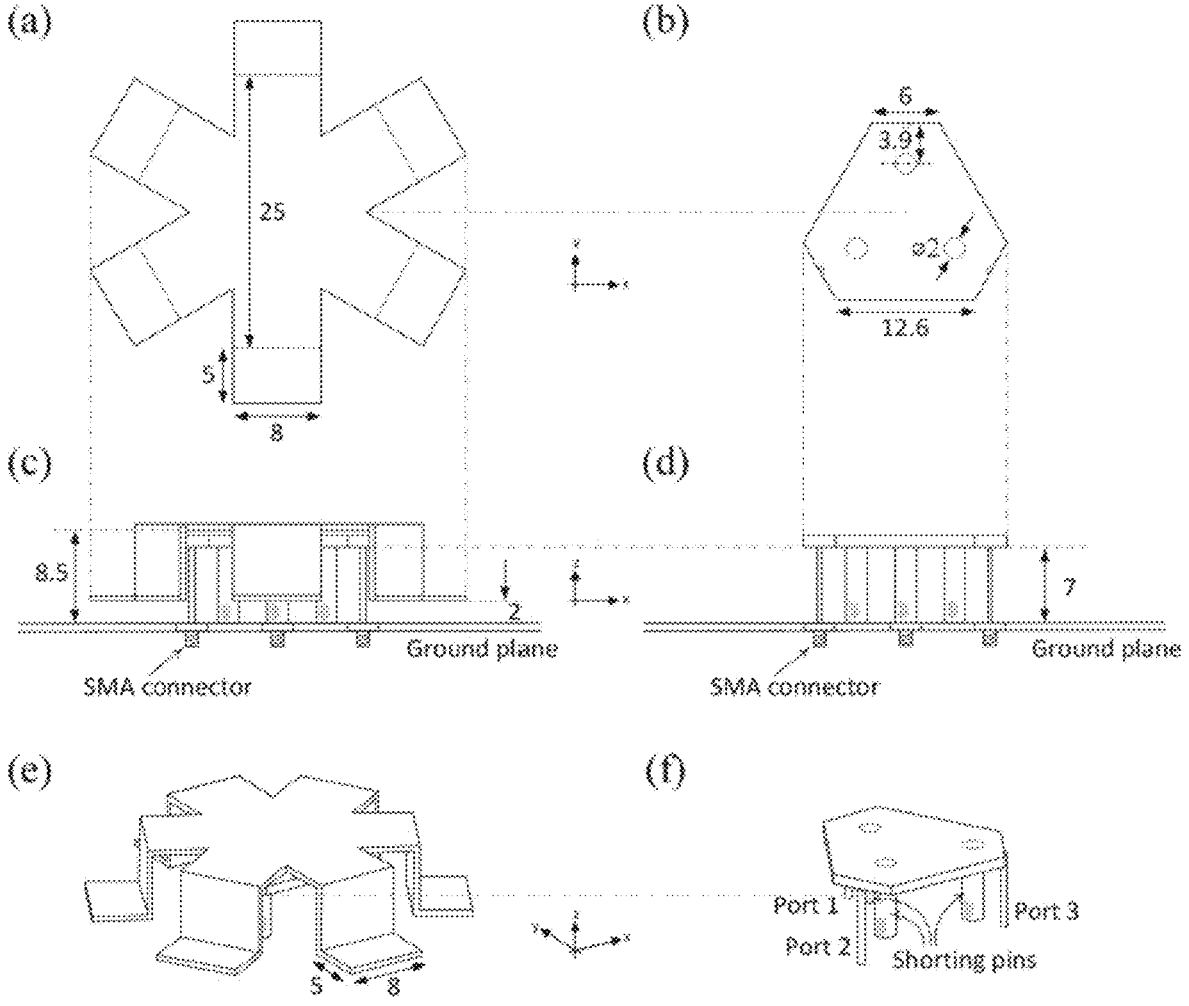
FIG. 2 shows an exemplary implementation of the compact 3-broadside-mode patch antenna depicted in FIGS. 1(*a*)-1(*c*), with dimension information in mm.

FIG. 2 shows another exemplary implementation of a compact 3-broadside-mode patch antenna, with dimension information in mm. As discussed above with respect to FIGS. 1(*a*)-1(*c*), the snowflake-shaped patch radiator has folded structures producing six capacitive loads to the antenna for miniaturization. The height of the air gap corresponding to each capacitive load is 2 mm. The ground plane is made on a circular FR4 epoxy board with diameter of 100 mm and having three SubMiniature version A (SMA) connectors soldered as the antenna interface. Copper or aluminum may be used for the construction of the snowflake-shaped patch radiator with folded structure. In addition to the capacitive loads, capacitive feeds are also provided (via a hexagonal patch) to achieve better impedance matchings. Part (a) of FIG. 2 shows the snowflake-shaped patch radiator. Part (b) of FIG. 2 shows the hexagonal patch. In this exemplary implementation, the material thicknesses of the snowflake-shaped patch radiator and the hexagonal patch are 0.5 mm and 1.0 mm, respectively. Furthermore, three 7 mm-long copper shorting pins with diameters of 2 mm are evenly distributed next to the three probes, as shown in parts (c) and (d) of FIG. 2. Part (e) of FIG. 2 shows a perspective view of the exterior structure, and part (f) of FIG. 2 shows a perspective view of the inner structure. Three antenna probes are connected to the hexagonal patch, but do not directly contact the snowflake-shaped radiator. The snowflake-shaped patch radiator is separated from the hexagonal patch via a dielectric (such as air), such that it is excited by the capacitive coupling of the non-contact hexagonal patch underneath. The ground plane may have a regular hexagonal shape, such that the entire antenna structure has 120-degree rotational symmetry, and is scalable to any number of antennas in the xy-plane.

It will be appreciated that the number of shorting pins used in a particular exemplary embodiment may vary. Using multiple shorting pins, such as three shorting pins as depicted in FIG. 2, may provide more accuracy when constructing a three-broadside-mode patch antenna by hand. Changing the number and/or location of shorting pin(s) affects the antenna input impedance matching, so different configurations of shorting pin(s) may correspond to different resonant frequencies (e.g., 2.8 GHz with one shorting pin in the center of a hexagonal patch versus 3.05 GHz with three shorting pins evenly distributed next to three probes.

Figure 3:
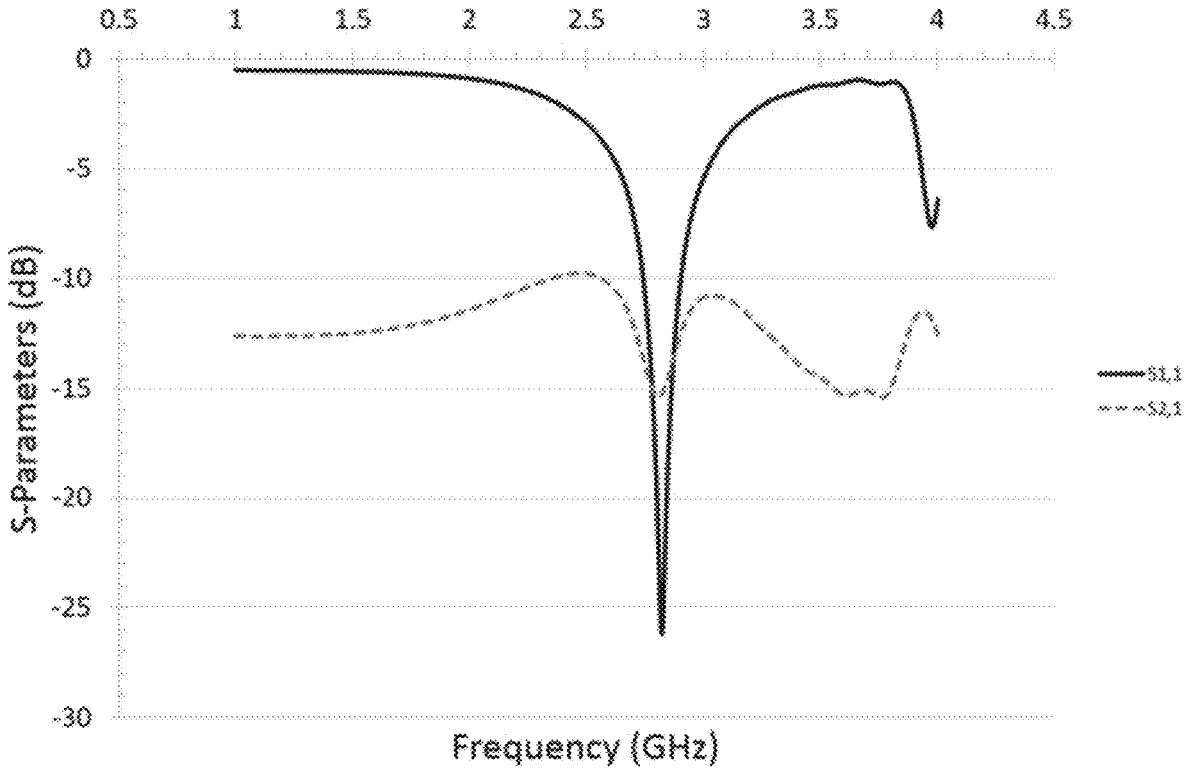
FIG. 3 shows a simulated frequency response of the compact 3-broadside-mode patch antenna with respect to a first antenna port.

FIG. 3 shows a simulated plot of variation of S-parameters along with frequency with respect to a first antenna port (antenna port 1). Since the geometry and the three excitations of the antenna are rotationally symmetric, the S-parameters with respect to the other antenna ports (antenna ports 2 and 3) would be the same. In this example, the antenna resonates at 2.8 GHz with mutual coupling of −15 dB.

Figure 4:
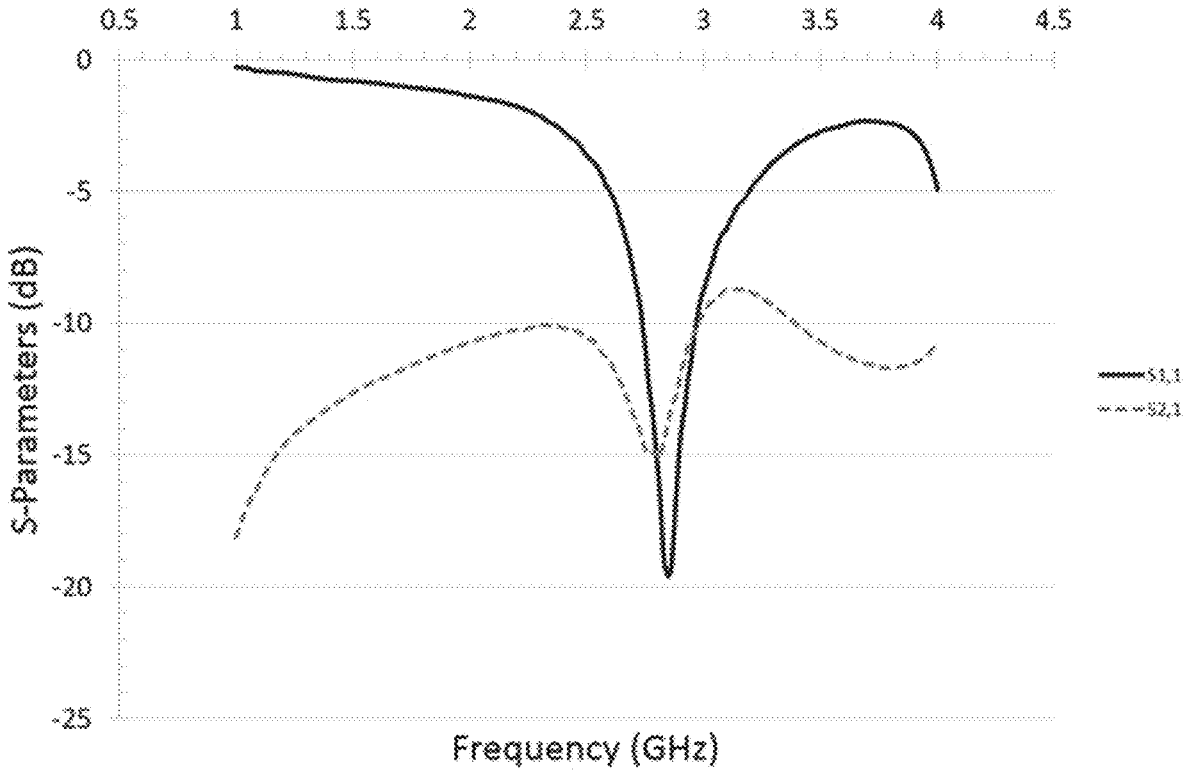
FIG. 4 shows a measured frequency response of the compact 3-broadside-mode patch antenna with respect to a first antenna port.

FIG. 4 shows a measured plot of variation of S-parameters along with frequency with respect to a first antenna port (antenna port 1). When compared to FIG. 3, it can be seen that the simulation results are consistent with the measurement results.

Figure 5:
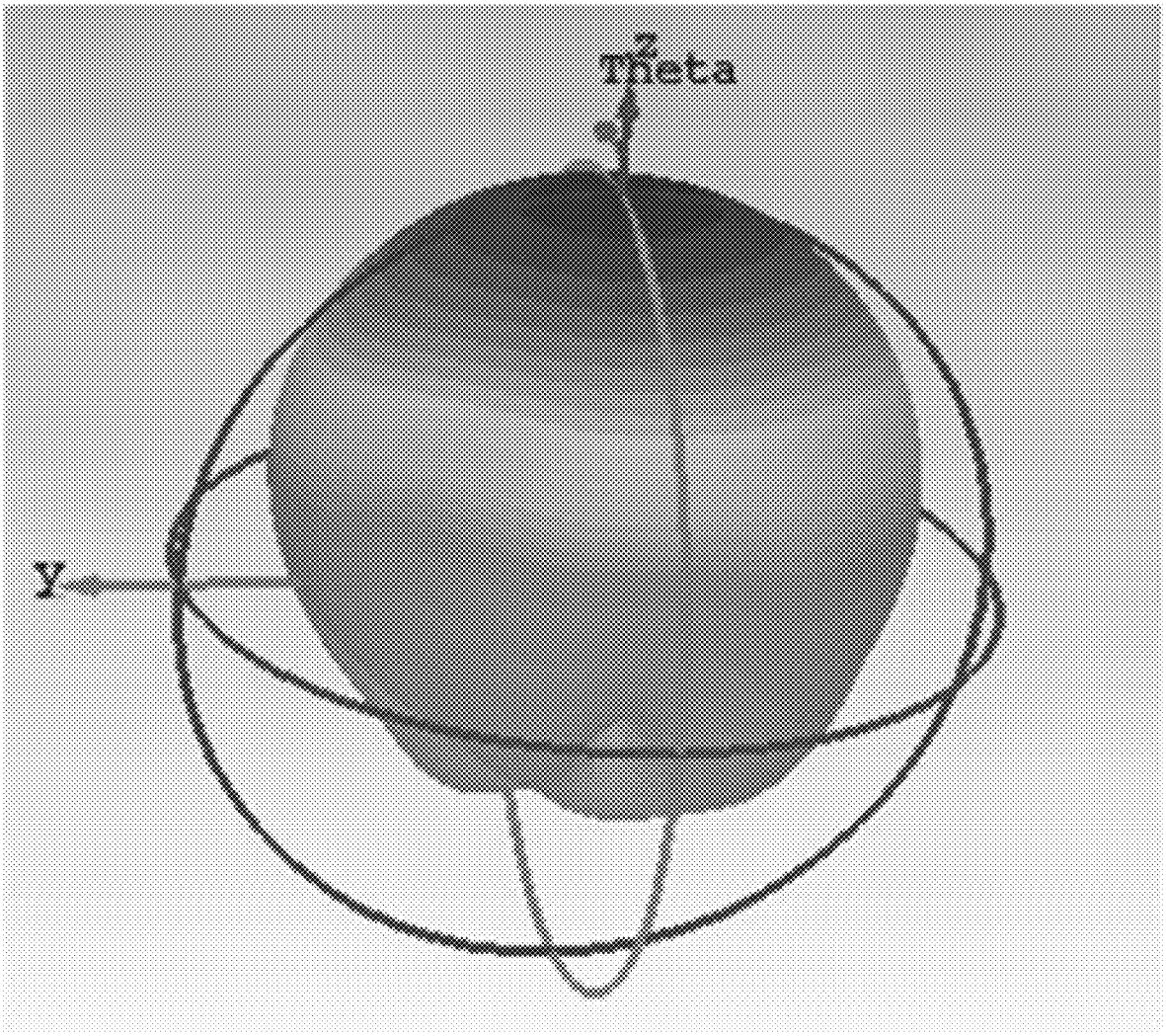
FIG. 5 shows a simulated radiation pattern of the compact 3-broadside-mode patch antenna with respect to a first antenna port at 2.8 GHz.

FIG. 5 shows a simulated radiation pattern of a compact 3-broadside-mode patch antenna at 2.8 GHz with respect to a first antenna port (antenna port 1). The radiation patterns of the other antenna ports (antenna ports 2 and 3) would be the same but rotated by +/−120 degrees due to the rotationally symmetric antenna geometry. Since the radiation pattern of the first antenna port (antenna port 1) is directed perpendicular to the plane of the top portion of the radiator, the radiation patterns of the other two antenna ports are also directed perpendicular to the plane of the top portion of the radiator.

Figure 6:
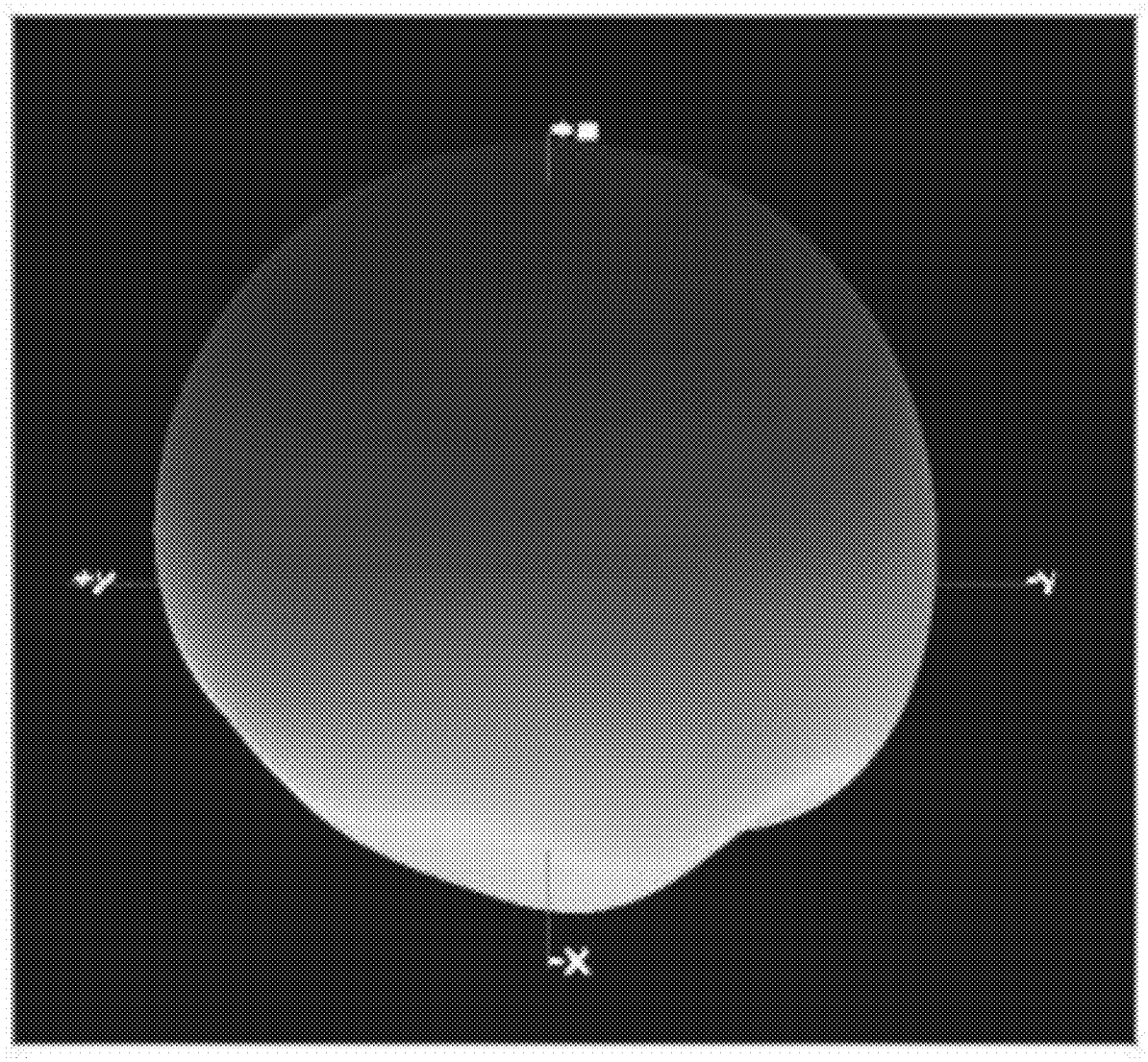
FIG. 6 shows a measured radiation pattern of the compact 3-broadside-mode patch antenna with respect to a first antenna port at 2.8 GHz.

FIG. 6 shows a measured radiation pattern of a compact 3-broadside-mode patch antenna with respect to a first antenna port (antenna port 1) at 2.8 GHz. The other antenna ports (antenna ports 2 and 3) are terminated with 50Ω loads during measurement. When compared to FIG. 5, it can be seen that the simulation results are consistent with the measurement results.

As mentioned above, multiple compact 3-broadside-mode patch antennas (or "compact 3-port antennas") may be joined together in an extendable manner having any number of unit cells (e.g., similar to the cells of a cellular network) to form a MIMO antenna. It will be appreciated that once the ground planes of multiple antennas are joined together, a larger common ground plane is formed with respect to the multiple antennas being joined together. It will further be appreciated that, alternatively, multiple antennas may be formed on a single common ground plane.

Figure 7:
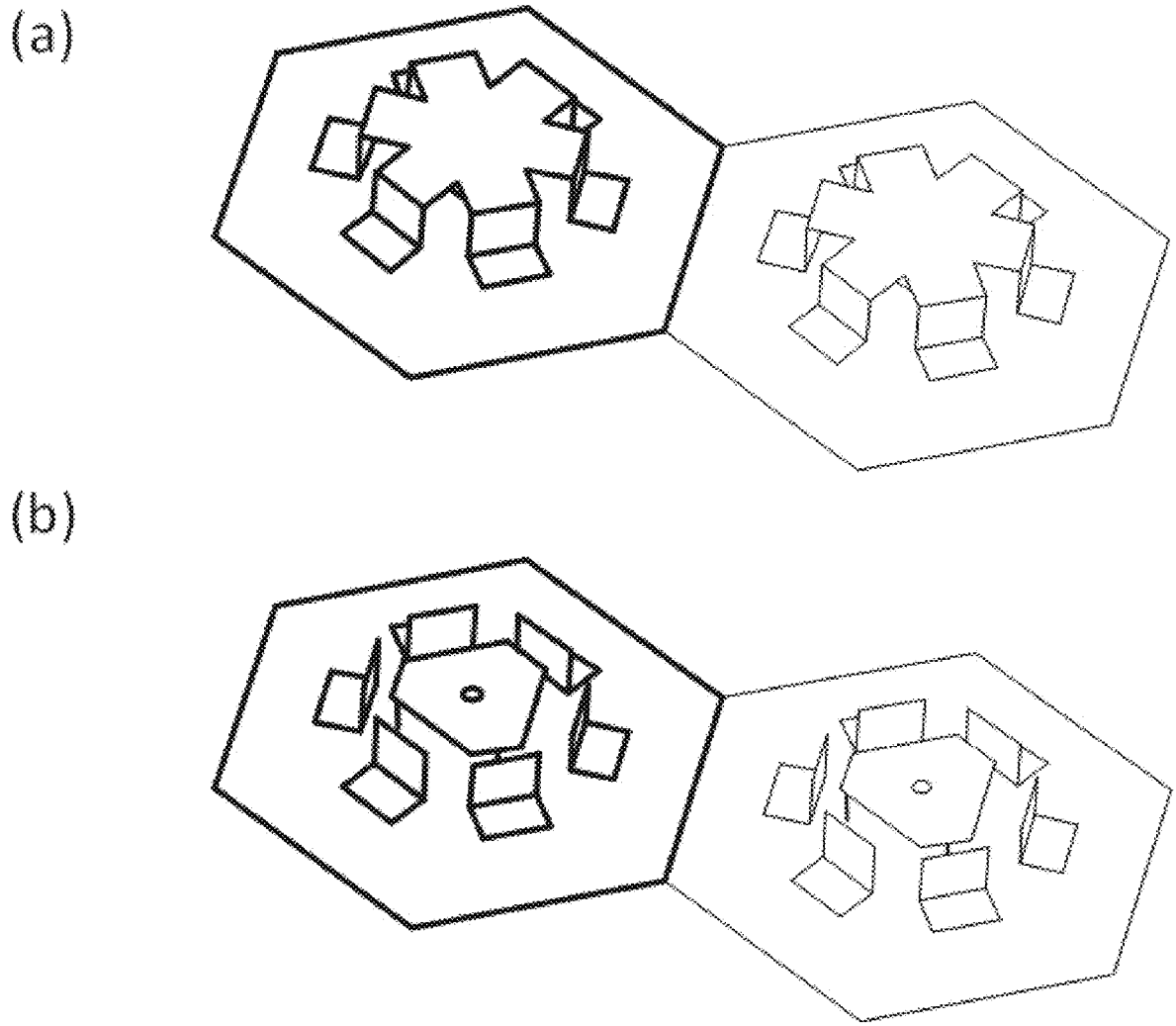
FIG. 7 shows two antennas with hexagonal ground planes joined together according to an exemplary embodiment (including: (a) a first perspective view, and (b) a second perspective view without the top portions of the patch radiators)
Figure 8:
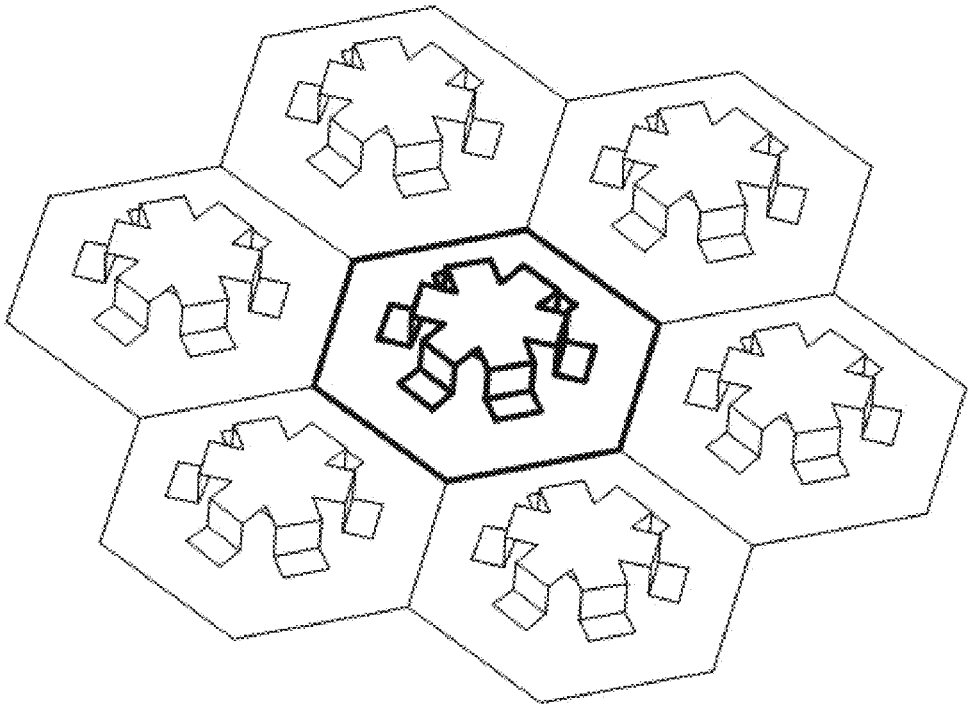
FIG. 8 shows seven antennas with hexagonal ground planes joined together according to an exemplary embodiment (including: (a) a first perspective view, and (b) a second perspective view without the top portions of the patch radiators)
Figure 8:
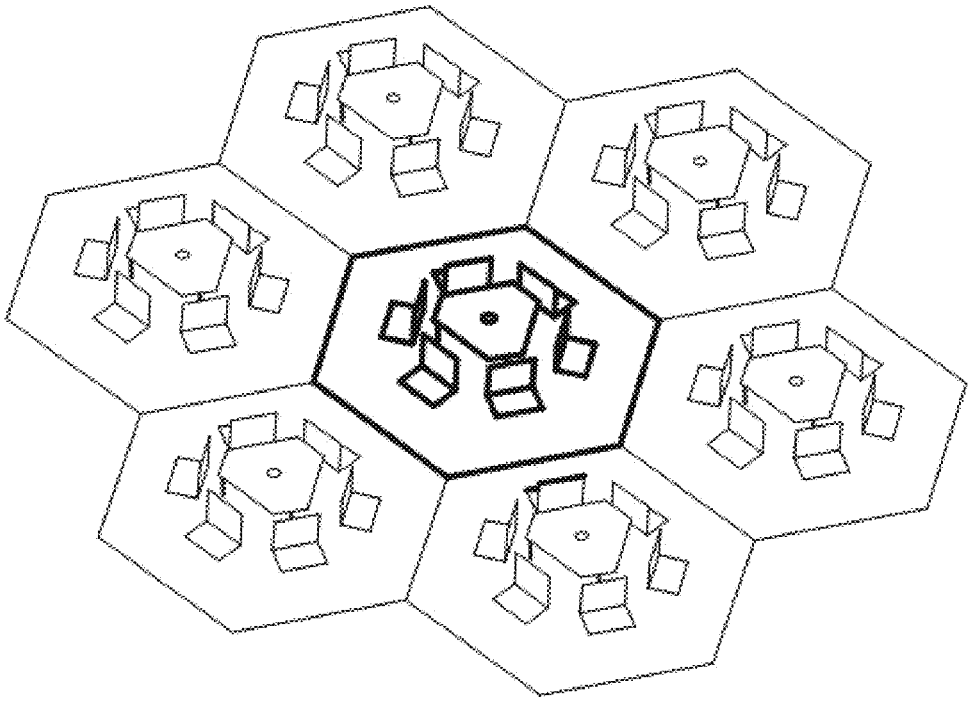
Figure 9:
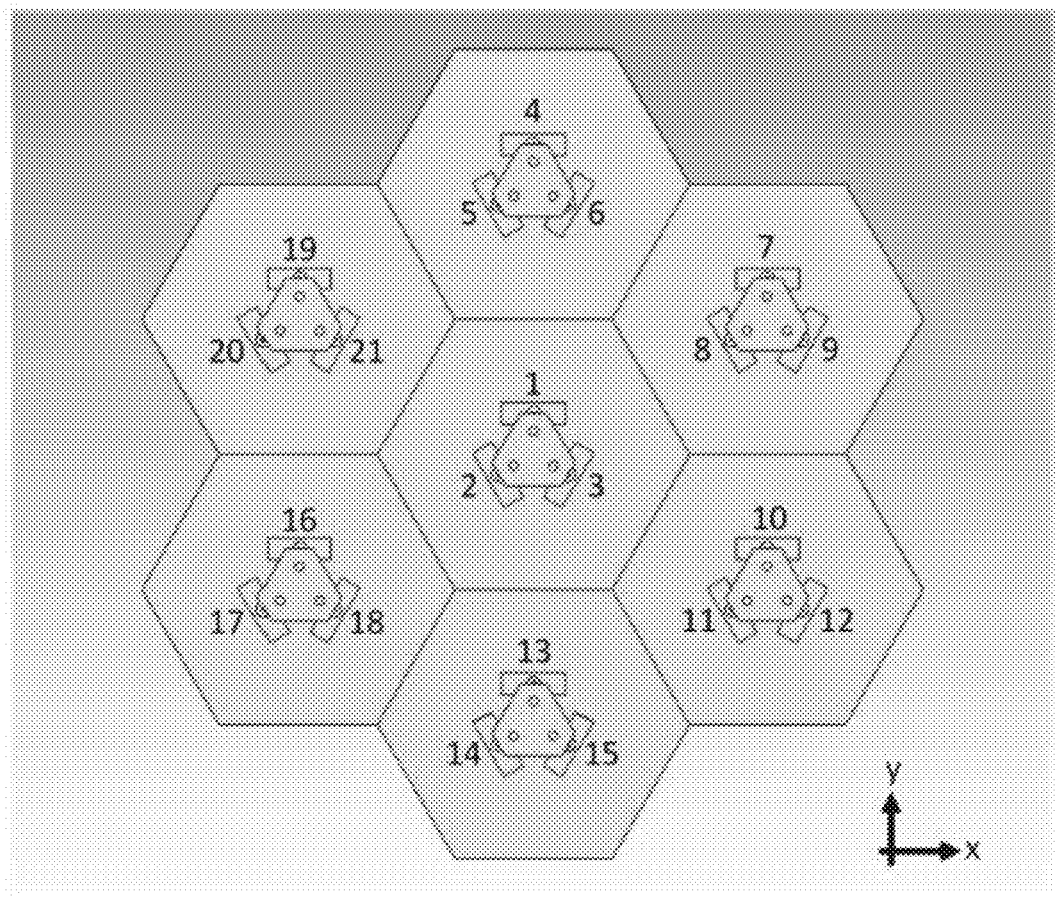
FIG. 9 shows another example of seven antennas with regular hexagonal ground planes joined together according to an exemplary embodiment (including: (a) a top view of the seven antennas without the top portions of the radiators, and (b) a perspective view of the seven antennas).
Figure 9:
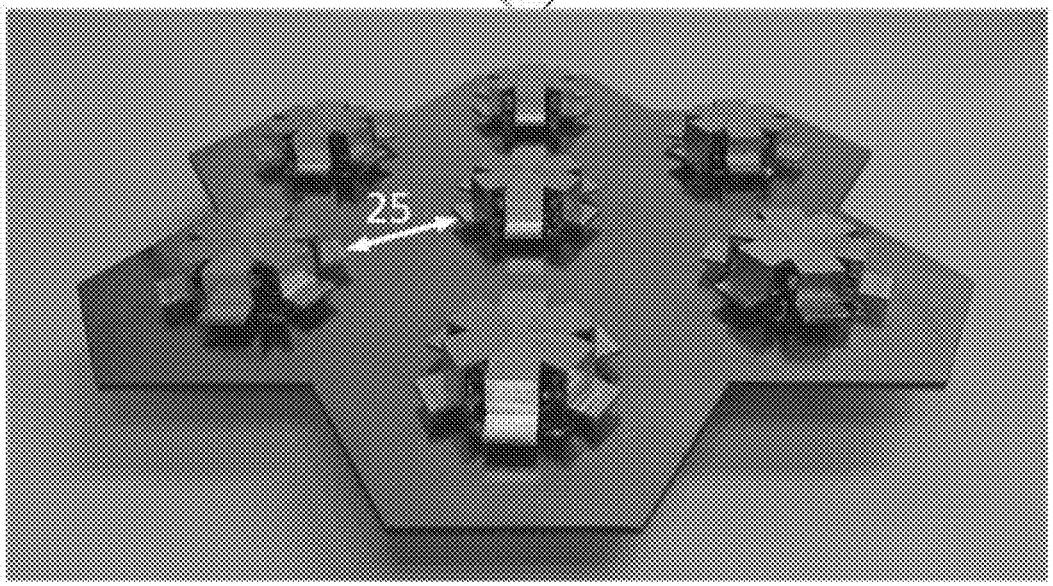

FIG. 7 shows two antennas with hexagonal ground planes joined together according to an exemplary embodiment. Part (a) of FIG. 7 shows a first perspective view of two compact 3-port antennas with regular hexagonal ground planes (which may each have the same structure as shown and described above in connection with FIGS. 1(*a*)-1(*c*)) being joined together. Part (b) of FIG. 7 shows a second perspective view of the two compact 3-port antennas with regular hexagonal ground planes without the top portions of the patch radiators. FIG. 8 shows seven antennas with hexagonal ground planes joined together according to an exemplary embodiment. Part (a) of FIG. 8 shows a first perspective view of seven compact 3-port antennas with regular hexagonal ground planes (which may each have the same structure as shown and described above in connection with FIGS. 1(*a*)-1(*c*)) being joined together. Part (b) of FIG. 8 shows a second perspective view of the seven compact 3-port antennas with regular hexagonal ground planes without the top portions of the patch radiators. FIG. 9 shows another example of seven antennas with regular hexagonal ground planes joined together according to an exemplary embodiment. Part (a) of FIG. 9 shows a top view of the seven antennas with regular hexagonal ground planes (which may each have the same structure as shown and described above in connection with FIGS. 1(*a*)-1(*c*)) without the top-side patch radiators and with antenna ports labeled 1-21. Part (b) of FIG. 9 shows a perspective view of the seven antennas with, for example, 25 mm of distance between respective legs of two top-side patch radiators (which provides for most or all inter-element mutual coupling coefficients being less than −20 dB). It will be appreciated that adjacent antennas are separated by some distance (such as 25 mm) to keep coupling low between separate unit cell antennas.

Figure 10:
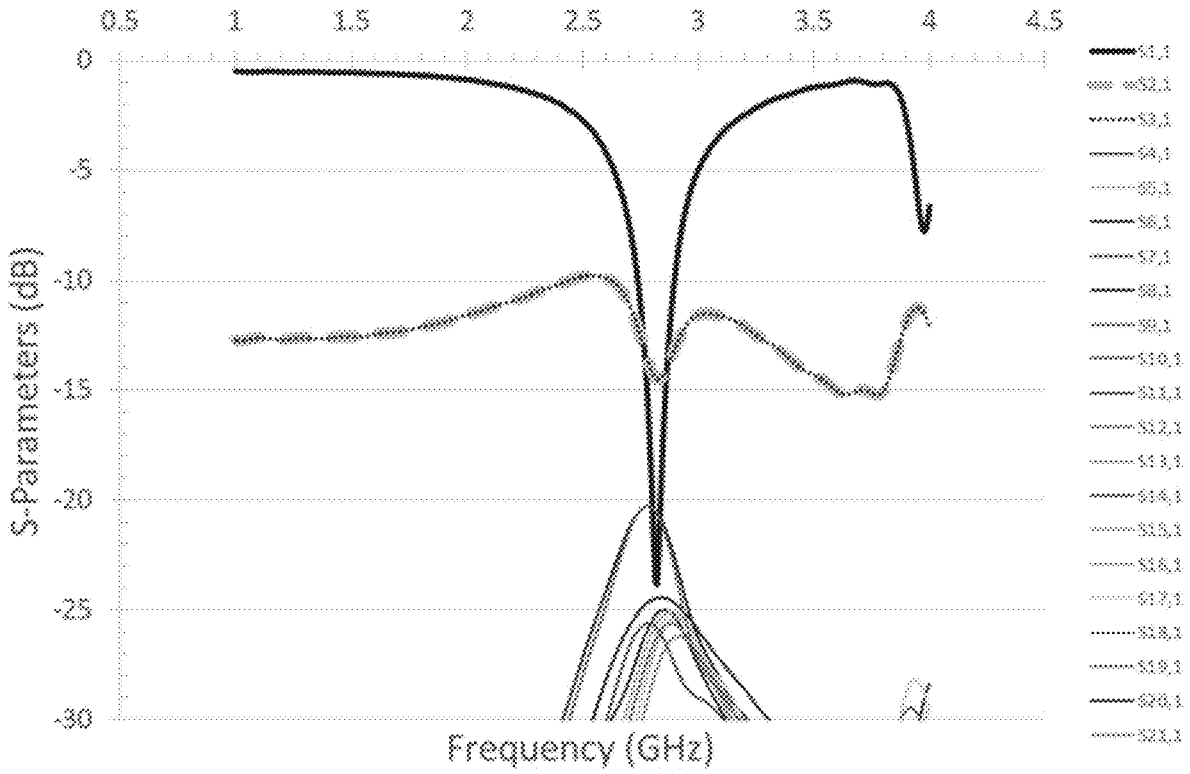
FIG. 10 shows a simulated frequency response of seven antennas with hexagonal ground planes joined together with respect to a first antenna port.

FIG. 10 shows a simulated plot of variation of S-parameters along with frequency with respect to a first antenna port (antenna port 1) of a set of seven compact 3-port antennas. Since the geometry and the excitations of the other antenna ports (antenna ports 2-21) are rotationally symmetric, the S-parameters with respect to the other antenna ports (antenna ports 2-21) would be the same. Further, referring to S2,1 and S3,1 the intra-element mutual coupling for seven antennas is similar to the results discussed above in connection with FIG. 3 (i.e., the antenna resonates at 2.8 GHz with mutual coupling of −15 dB). And referring to S4,1 through S21,1, it can be seen that the inter-element mutual couplings are low (all below −20 dB) when the edge-to-edge neighboring element spacing is $0.54\lambda_0$ and without applying any decoupling techniques. The inter-element mutual couplings mainly depend on the inter-element spacing, so there may be a tradeoff between compact size versus reducing inter-element mutual couplings (i.e., the smaller the inter-element spacing, the higher the inter-element mutual coupling, which may degrade antenna efficiency). As mentioned above, in an exemplary implementation, having 25 mm of inter-element spacing provides for most or all inter-element mutual coupling coefficients being less than −20 dB (less than −15 dB is good enough for most applications).

Figure 11:
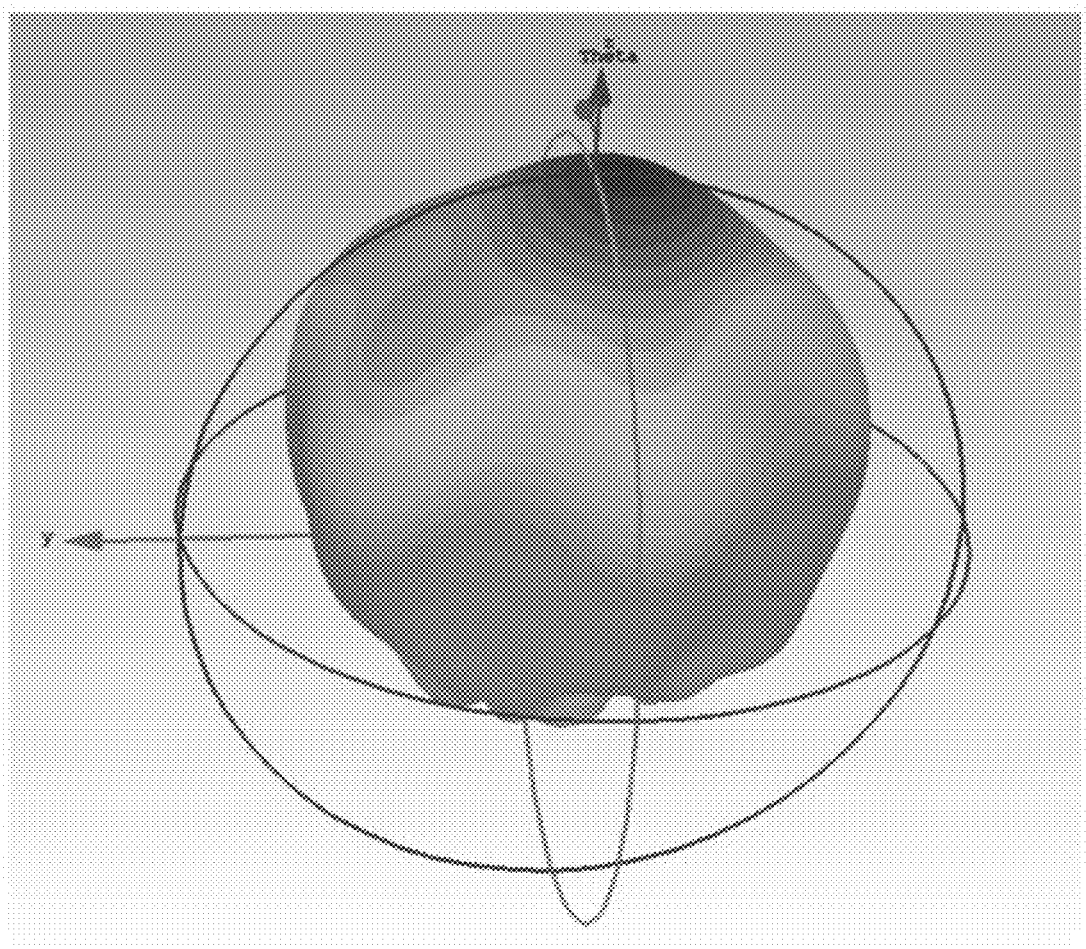
FIG. 11 shows a simulated radiation pattern of seven antennas with hexagonal ground planes joined together with respect to a first antenna port at 2.8 GHz.

FIG. 11 shows a simulated radiation pattern at 2.8 GHz with respect to a first antenna port (antenna port 1) of a set of seven compact 3-port antennas. Since the radiation pattern of antenna port 1 is directed perpendicular to the plane of the top portion of the radiator, so the radiation patterns of the other antenna ports are also directed perpendicular to the plane of the top portion of the radiator due to the rotationally symmetry.

It will be appreciated that more than seven antennas may be joined together, up to virtually any number of antennas. It will further be appreciated that although FIGS. 7-9 show compact 3-port antennas having hexagonal ground planes being joined together, antennas having ground planes of other shapes may also be joined together.

Exemplary embodiments of the invention provide a compact integrated 3-port antenna with broadside radiation patterns. It will be appreciated that the invention is not limited to a specific resonant frequency, which is determined by the size of the antenna. For example, a lower resonant frequency can be obtained by scaling up the size of the antenna.

As discussed above, exemplary embodiments of the invention provide a compact 3-broadside-mode patch antenna.

As discussed above, the performance of the three ports of the 3-broadside-mode patch antenna may be identical due to rotationally symmetric geometry.

As discussed above, low mutual coupling between the three antenna ports can be achieved.

As discussed above, a single patch antenna can generate more than two broadside radiation patterns with low mutual coupling.

As discussed above, a folded snowflake-shaped patch radiator may be used, wherein the shape of the snowflake-shaped patch radiator matches with a hexagonal ground plane. The folded snowflake-shaped patch radiator can reduce the projection area of the overall antenna. The folded snowflake-shaped patch radiator can produce capacitive loading effect resulting of antenna size reduction.

The capacitive feed of antenna port excitations can provide for better impedance matching (by canceling out certain probe inductance). The long and thin antenna probes can be regarded as an inductance from a radio frequency (RF) point of view. The inductance may cause mismatches which introduces mismatched loss to the antenna. The capacitive feed, however, provides additional capacitance near the probe such that probe inductance can be cancelled out.

As discussed above, two or more, or seven or more, hexagonal ground planes can be seamlessly connected together in a manner that can be extended to any number of unit cells without overlap or empty space between unit cells. Additionally, two or more, or seven or more, compact 3-broadside-mode patch antennas can be seamlessly connected together. The compact 3-broadside-mode patch antenna according to exemplary embodiments of the invention can thus be used as a unit cell for building massive MIMO antennas.

It will be appreciated that although the exemplary embodiments described herein utilize a snowflake-shaped radiator having six legs, other types of radiators may be used in other exemplary embodiment. For example, other rotationally symmetric radiators capable of providing three broadside radiation modes may be used (such other radiators having 120-degree rotational symmetry or radiators having 60-degree rotational symmetry).

Exemplary embodiments of the present application further provide a compact antenna structure for three-port wideband operation. The three antenna ports are able to exhibit broadside radiation from three ports being excited simultaneously while maintaining low mutual coupling over a wide frequency range (e.g., shown to be at least 19.7% in an exemplary embodiment). The largest dimension in the projection area of the three-port antenna may be $0.48\lambda_o$ or approximately $0.48\lambda_o$ (where $\lambda_o$ is the wavelength in air), which is similar to a standard half-wavelength dual-polarized two-port patch antenna counterpart. This means that a 50% increase in the number of antenna ports can be realized (relative to a conventional half-wavelength dual-polarized patch antenna counterpart). This can be considered a wideband version of exemplary embodiments described previously herein, in which the 10 dB impedance bandwidth has been enhanced, for example, from around 4.3% to 19.7% or more. Further, exemplary embodiments are not limited to a specific resonant frequency, which is determined by the size of the antenna (e.g., a lower resonant frequency can be obtained by scaling up the entire antenna element), and are not limited to a specific antenna geometry (so long as it is rotationally symmetric).

In an exemplary embodiment, the snowflake-shaped radiator with six folded branches towards ground plane, as described above, may be modified to include three unfolded branches plus three folded branches towards ground plane. The folded and unfolded branches are arranged alternatively, and this architecture assists in generating two nearby antenna resonances for wideband operation. The shape of the branches may also be optimized to help achieve better impedance matching over the frequency band of interest.

Owing to the rotational symmetric geometry with respect to the three antenna ports (e.g., rotational symmetry of 120 degrees), exemplary embodiments of the antenna are usable as a unit cell and are able to be tessellated to form a massive MIMO array with all mode radiations pointing in the broadside direction. Exemplary embodiments of the antenna are thus scalable to any number in the azimuth plane for meeting the needs of MIMO systems. In addition, a hexagon-like antenna geometry facilitates the suppression of inter-element mutual coupling after concatenation. In an exemplary implementation, it was demonstrated that exemplary embodiments are capable of covering most 3 GHz ranges used in 5G communication systems (e.g., 3.3 to 3.6 Ghz and 3.4 to 3.8 GHz for China and Europe). A circular geometry may also be used.

Figure 12:
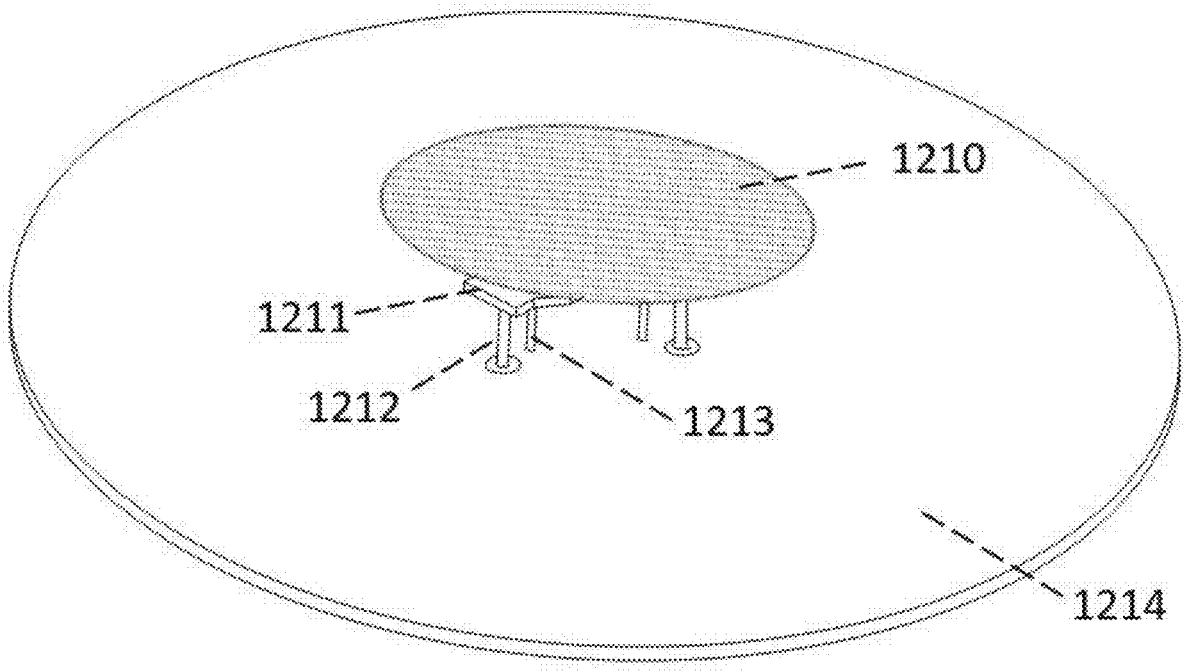
FIG. 12 shows a general structure of a three-broadside-mode patch antenna.

FIG. 12 shows a general structure of a three-broadside-mode patch antenna. The antenna includes a rotational symmetric patch radiator 1210 which is made of metal (e.g., a good conductor such as brass, copper, or aluminum) and is suspended in air (or a foam material may be used instead of air because it offers a low dielectric constant (close to 1) which is close to that in air). The radiator 1210 is not limited to a specific geometry, and may be circular, hexagonal or another rotationally symmetric shape which exhibits 120° or $3^{rd}$ order rotational symmetry when viewed from the top. The radiator 1210 is also not limited to a single layer structure, and may include multiple layers with folded structuring (in some exemplary embodiments, it may be advantageous to include a multi-layer folded structure to reduce the largest lateral dimension of the antenna while keeping the resonant frequency unchanged). The radiator 1210 may be capacitively fed by three feeding patches 1211 which are made of metal (e.g., a good conductor such as brass or copper). The feeding patch is not limited to a specific geometry, and may be circular, rectangular, or a rotationally symmetric shape which exhibits 120° or $3^{rd}$ order rotational symmetry when viewed from the top. Further, the feeding patch may be divided into multiple smaller feeding patches, such as three identical small feeding patches 1211 corresponding to three antenna ports, to generate additional capacitance for impedance matching. Each feeding patch 1211 is excited by a respective probe 1212 and shorted by a respective metal pin 1213. The metal pins 1213 are connected to a ground plane 1214 which is made of metal (e.g., a good conductor such as brass or copper) and is not limited to a specific geometry (e.g., cylindrical or flat metal). The dielectric spacing (e.g., air gap) between the radiator 1210 and the feeding patch 1211, the location of metal pins 1213, and the shape of branches assist in determining impedance matching of the antenna.

To optimize the impedance matching for the antenna, the branch or spoke shape for the radiator may be modeled as a combination of resistance, capacitance and inductance; the dielectric spacing may be modeled as additional capacitance; and the shorting pin may be modeled as additional inductance. Then, the contributions of each of these factors with regard to positive or negative impact on impedance matching may be taken into consideration to provide a configuration which is optimized for impedance matching. This may be achieved, for example, via electromagnetic simulation.

In an exemplary embodiment, the largest lateral dimension of radiator 1210 in FIG. 12 may be approximately $0.5\lambda_0$, and its height above the ground plane may be approximately $0.1\lambda_0$.

Figure 13A:
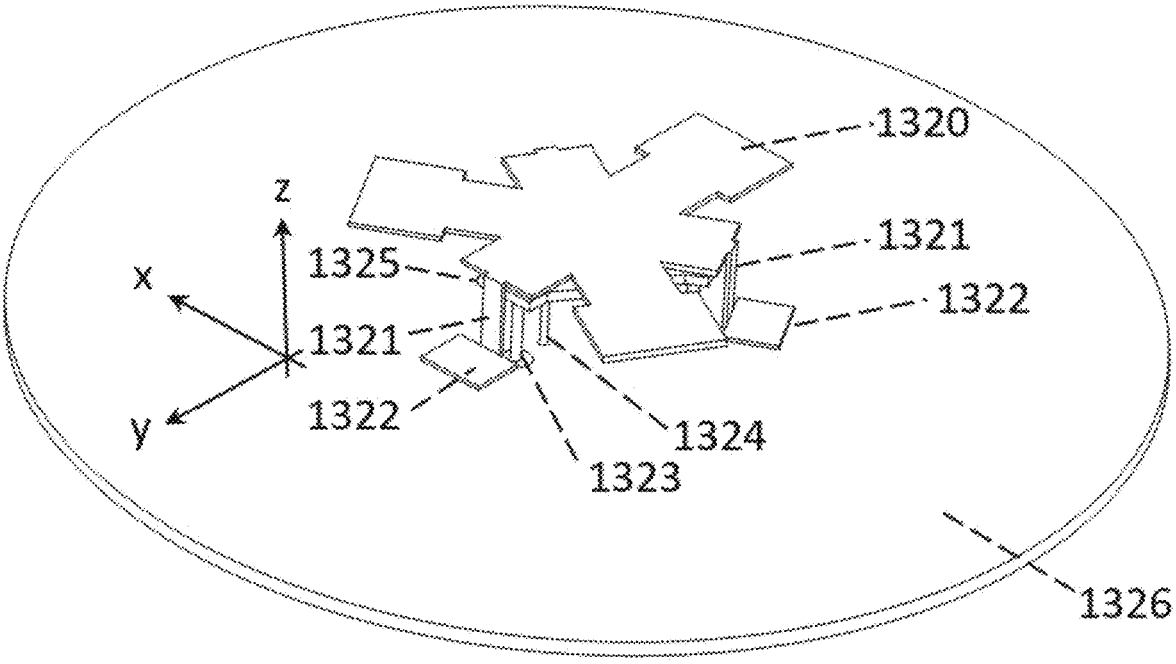
FIGS. 13(*a*)-13(*b*) show an exterior view and a perspective view of the structure of a compact wideband three-broadside-mode patch antenna according to an exemplary embodiment.
Figure 13B:
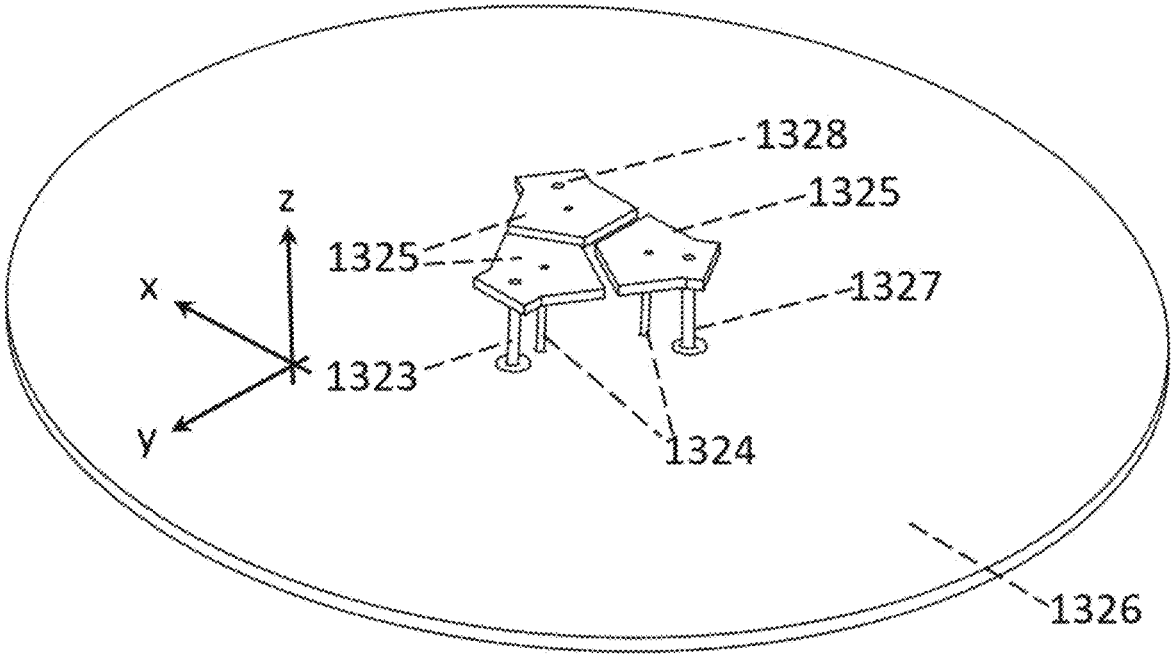

FIGS. 13(*a*)-13(*b*) show an exterior view and a perspective view of the structure of a compact wideband three-broadside-mode patch antenna according to an exemplary embodiment.

FIG. 13(*a*) shows the patch radiator 1320 as a snowflake-shaped structure with six branches. The radiator 1320 has a two-layer architecture possessing three vertical structures 1321 connected to three lower layer structures 1322. In other words, the six branches (or six spokes) are interlaced in an up and down arrangement. The radiator 1320 is suspended in air and is capacitively fed by three identical feeding patches 1325 (capacitive loading plates) which exhibit 120° or third order rotational symmetry and are made of metal. By using three feeding patches 1325 instead of one, the lower resonance is moved upwards, thereby merging two resonances. Since each resonance sustains an impedance bandwidth, the merging of two nearby resonances is able to achieve a larger impedance bandwidth respect to a benchmark of reflection being lower than −10 dB.

The folded and unfolded branches assist in generating two nearby antenna resonances for wideband operation. In other words, exemplary embodiments of the application provide a dual-resonance structure to achieve wideband operation: by increasing the length of the electrical path of a respective branch (folded) of a snowflake-shaped radiator while decreasing the length of the electrical path of the opposite branch (unfolded), the resulting structure can be viewed as two superimposed Y-shaped structures of different resonant frequencies. And when the two resonant frequencies are close enough, the impedance bandwidth is enlarged.

The folded structuring may also reduce the overall antenna projection area in the xy-plane. The resonant frequency of an antenna is inversely proportional to the electrical length of the antenna. Thus, to keep the resonant frequency unchanged while minimizing the overall footprint, a multi-layered folded structure can be used to reduce the largest lateral dimension of the antenna. This is advantageous, for example, when packing a large number of antennas together to form a massive MIMO array.

The shape of the branches can be optimized providing additional parameters for impedance matching over a wide frequency range corresponding to two nearby antenna resonances. As mentioned above, the branch or spoke shape of the radiator may be modeled as a combination of resistance, capacitance and inductance, and the impedance is adjustable by tuning the branch shape. Compared with rectangular patches, snowflake-shaped patches provide more dimensions for tuning.

FIG. 13(*b*) shows a perspective view of the structure of a compact wideband three-broadside-mode patch antenna with the top-side radiator 1320 removed. As mentioned above, there is an air gap such that there is no physical contact between the radiator 1320 and the three feeding patches 1325. The three feeding patches 1325 are simultaneously excited by three individual probes 1323, 1327 and 1328 corresponding to first, second and third ports, respectively. The three feeding patches 1325 are also shorted by three metal pins 1324. The metal pins 1324 are connected to a circular ground plane 1326 which, for example, may be printed on an FR-4 epoxy board.

The antenna probes 1323, 1327 and 1328 may be considered as inductors in which the inductance is proportional to length. Thus, if the probe length is long, a large inductance may deteriorate the matching of the antenna. However, by providing a capacitive feed, at least a part of the probe inductance may be canceled out.

In an exemplary embodiment, the overall lateral size of the three feeding patches 1325 is smaller than that of radiator 1320 such that the three feeding patches 1325 can be accommodated inside without touching the radiator 1320.

Figure 14:
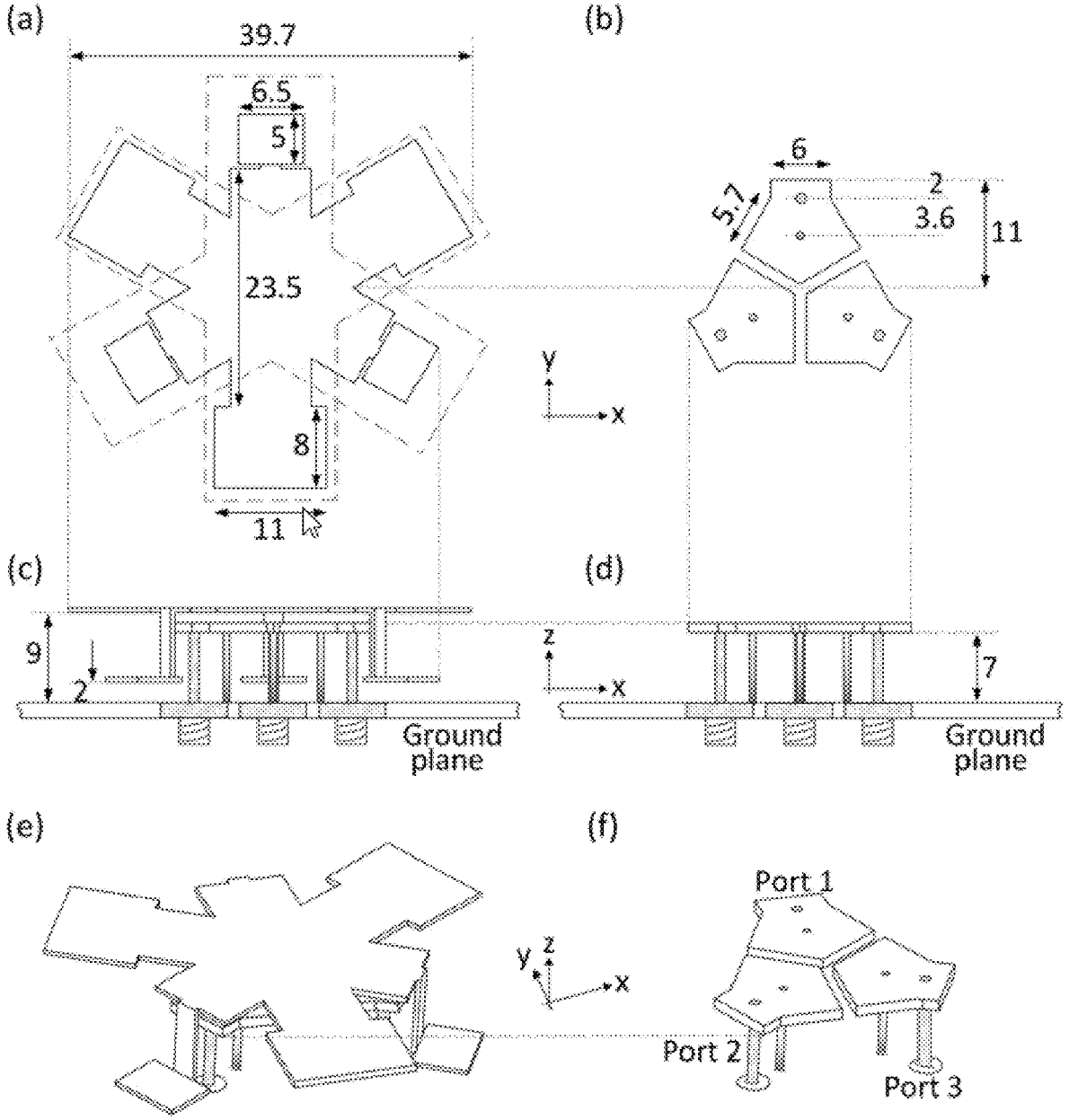
FIG. 14 shows an exemplary implementation of the compact wideband three-broadside-mode patch antenna depicted in FIGS. 13(*a*)-13(*b*), with dimension information in mm.

FIG. 14 shows an exemplary implementation of the compact wideband three-broadside-mode patch antenna depicted in FIGS. 13(*a*)-13(*b*), with exemplary dimension information in mm. Rather than having six identical branches (as shown in the exemplary embodiment shown in part (a) of FIG. 2), the shape of the radiator in this embodiment can be thought of as having two overlapping Y-structures with different shapes (shown by the dotted lines) interlaced with each other as shown in part (a) of FIG. 14.

The snowflake-shaped patch radiator has three branches or spokes with folded structures and three branches or spokes with unfolded structures.

The height of the air gap corresponding to each capacitive load is 2 mm. The ground plane is made on a circular FR4 epoxy board with diameter of 100 mm and having three SubMiniature version A (SMA) connectors soldered as the antenna interface. Copper or aluminum may be used for the construction of the snowflake-shaped patch radiator. In addition to the capacitive loads, capacitive feeds are also provided (via the three identical patches) to achieve better impedance matching.

Part (a) of FIG. 14 shows the snowflake-shaped patch radiator. Part (b) of FIG. 14 shows the three feeding patches. In this exemplary implementation, the material thicknesses of the snowflake-shaped patch radiator and the three feeding patches are 0.5 mm and 1.0 mm, respectively. Furthermore, three 7 mm-long copper shorting pins with diameters of 1 mm are located next to the three probes, as shown in parts (c) and (d) of FIG. 14. Part (e) of FIG. 14 shows a perspective view of the exterior structure, and part (f) of FIG. 14 shows a perspective view of the inner structure.

Three antenna probes (labeled as Probes 1-3) are connected to the three feeding patches, but do not directly contact the snowflake-shaped radiator. The snowflake-shaped patch radiator is separated from the three feeding patches via a dielectric (such as air), such that it is excited by the capacitive coupling of the three non-contact feeding patches underneath.

The ground plane may have a regular hexagonal shape, such that the entire antenna structure has 120-degree rotational symmetry, and is scalable to any number of antennas in the xy-plane.

FIG. 14 shows exemplary dimensions (in mm) of certain elements depicted in parts (a)-(d) of FIG. 14 for a compact wideband 3-port antenna that operates from 3.25 GHz to 3.96 GHz. Part (a) of FIG. 14 shows that the largest lateral dimension of the snowflake-shaped radiator is 39.7 mm, corresponding to $0.48\lambda_0$. Part (b) of FIG. 14 shows that the three feeding patches may have side lengths of 2 mm, 6 mm and 5.7 mm. Part (c) of FIG. 14 shows that the height of the vertical portions of the folded legs is 7 mm (i.e., 9 mm−2 mm as shown). Part (d) of FIG. 14 shows that the height of the shorting pin is 7 mm. Additionally, the width of the vertical portions of the folded legs is 2 mm, and there is 1 mm of separation between the snowflake-shaped radiator and the patch (e.g., via a dielectric such as air). It will be appreciated that other exemplary implementations may utilize other respective dimensions and other resonant frequencies.

Figure 24A:
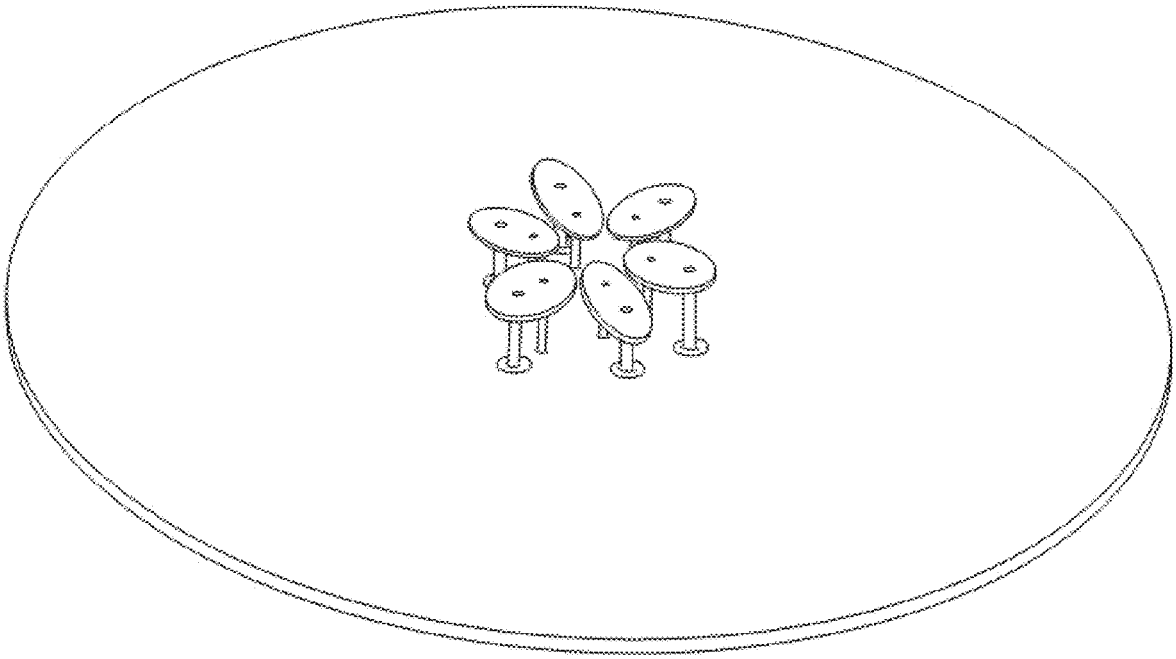
FIGS. 24(*a*)-24(*b*) show perspective views of a compact dual-band six-broadside-mode patch antenna according to an exemplary embodiment.
Figure 24B:
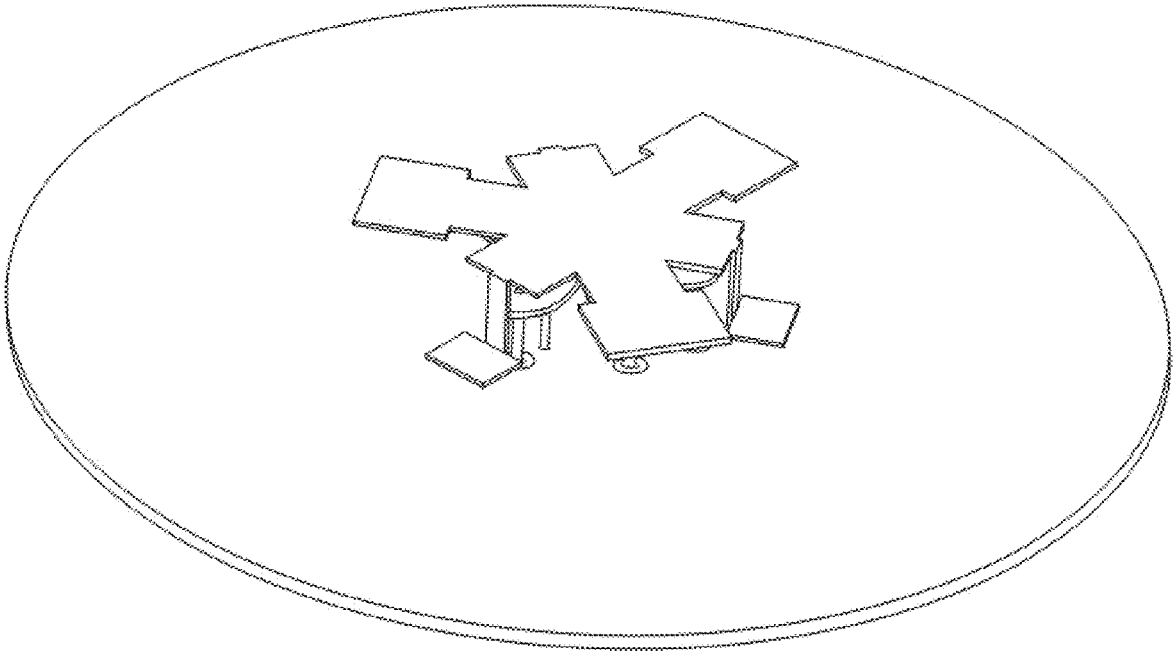

In an alternative embodiment, the two nearby resonant frequencies of the radiator are not close enough to be merged, and the radiator provides for dual-band operation of the antenna instead of wideband operation. For example, in an exemplary implementation of this alternative embodiment, the exemplary embodiment shown in FIG. 13(*b*) may be modified to add three more antenna ports and capacitive feeds. Thus, two sets of three antenna feeds (corresponding to a total of six ports per unit cell) may be simultaneously utilized to excite the radiator (e.g., a snowflake-shaped patch radiator) for dual-band operation, with first, third and fifth ports corresponding to a first resonance, and second, fourth and sixth ports corresponding to a second resonance. An example of this alternative embodiment is shown in FIGS. 24(*a*)-24(*b*). FIGS. 24(*a*)-24(*b*) show perspective views of a compact dual-band six-broadside-mode patch antenna according to an exemplary embodiment. The six-broadside-mode patch antenna includes: a rotationally symmetric radiator; one or more patches, wherein the one or more patches are separated from the rotationally symmetric radiator by a dielectric and configured to capacitively feed the rotationally symmetric radiator; and six antenna probes, connected to the one or more patches, configured to simultaneously excite the one or more patches for capacitively feeding the rotationally symmetric radiator and generating six respective broadside radiation polarizations. FIG. 24(*a*) depicts an example of the compact dual-band six-broadside-mode patch antenna having six identical patches (corresponding to six antenna probes) without the radiator. FIG. 24(*b*) depicts an example of the compact dual-band six-broadside-mode patch antenna having a snowflake-shaped patch radiator (similar to FIG. 13(*a*)).

In another alternative embodiment, all six branches or spokes of the radiator are folded. In another alternative embodiment, all six branches or spokes of the radiator are unfolded. In either of these alternative embodiments, alternating branches or spokes may have different lengths, sizes or shapes depending on the resonant frequencies and the desired overall size of the antenna.

Figure 15A:
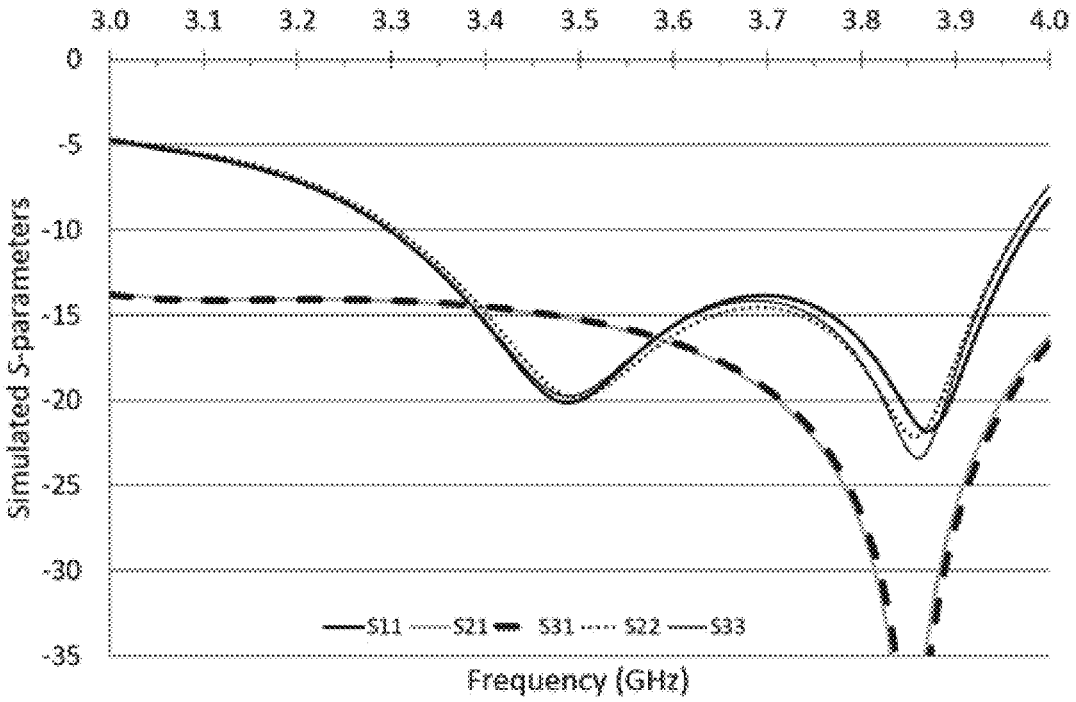
FIGS. 15(*a*)-15(*b*) show simulated and measured frequency responses of an exemplary embodiment of a compact wideband three-mode patch antenna.
Figure 15B:
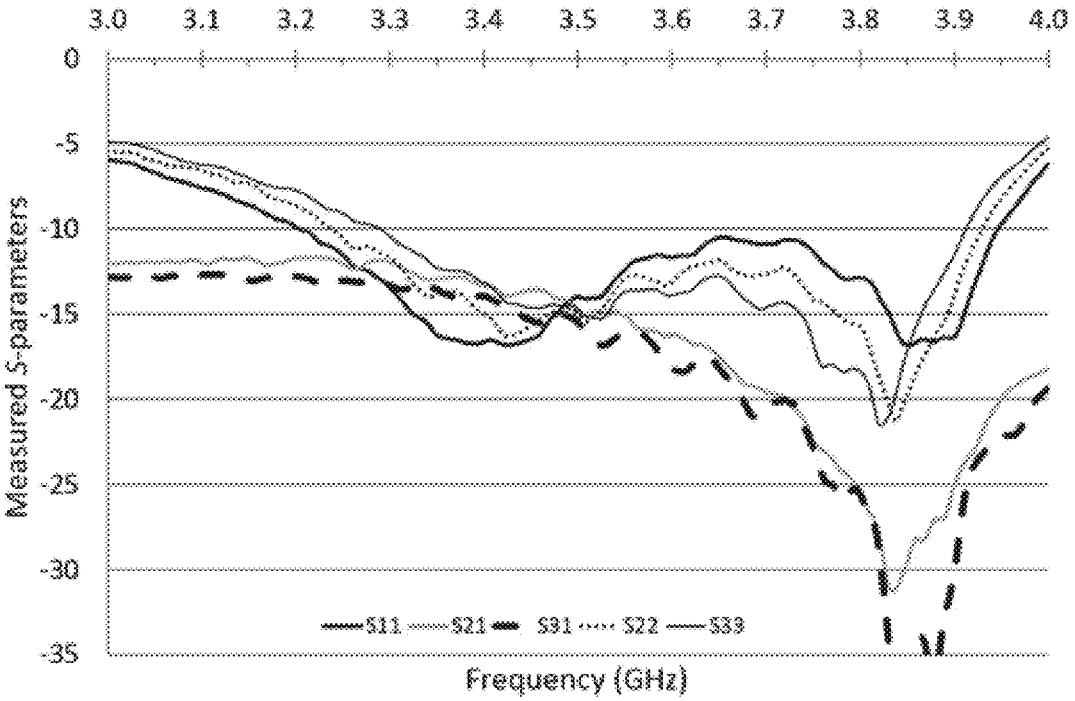

FIG. 15(*a*) shows a simulation schematic diagram of variation of S-parameters along with frequency with respect to different antenna ports for an exemplary embodiment of a compact wideband three-broadside-mode patch antenna. As the entire antenna structure is rotationally symmetric, the reflection coefficients S11, S22 and S33 should be identical theoretically. Also, the mutual coupling between ports should be identical. However, there is a little discrepancy between ports due to the meshing in the electromagnetic (EM) calculation. In this example, the 10 dB impedance bandwidth is 18.2%, and the coupling coefficient between any two ports is lower than −14.2 dB within this band.

FIG. 15(*b*) shows a measurement schematic diagram of variation of S-parameters along with frequency with respect to different antenna ports for an exemplary embodiment of a compact wideband three-broadside-mode patch antenna. There is a little discrepancy between ports due to fabrication tolerance, but manufacturing accuracy can be improved by prototyping in a commercial workshop. In any event, when compared to FIG. 15(*a*), it can be seen that agreement between simulation and measurement results was demonstrated in this example.

Figure 16A:
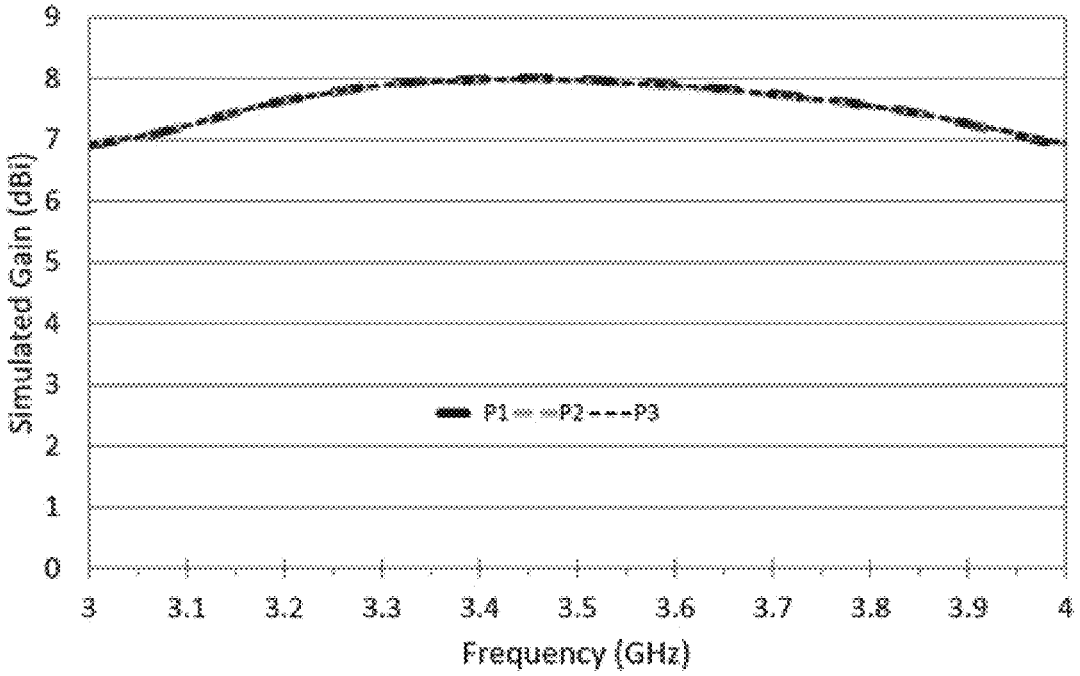
FIGS. 16(*a*)-16(*b*) show simulated and measured gain of an exemplary embodiment of a compact wideband three-mode patch antenna.
Figure 16B:
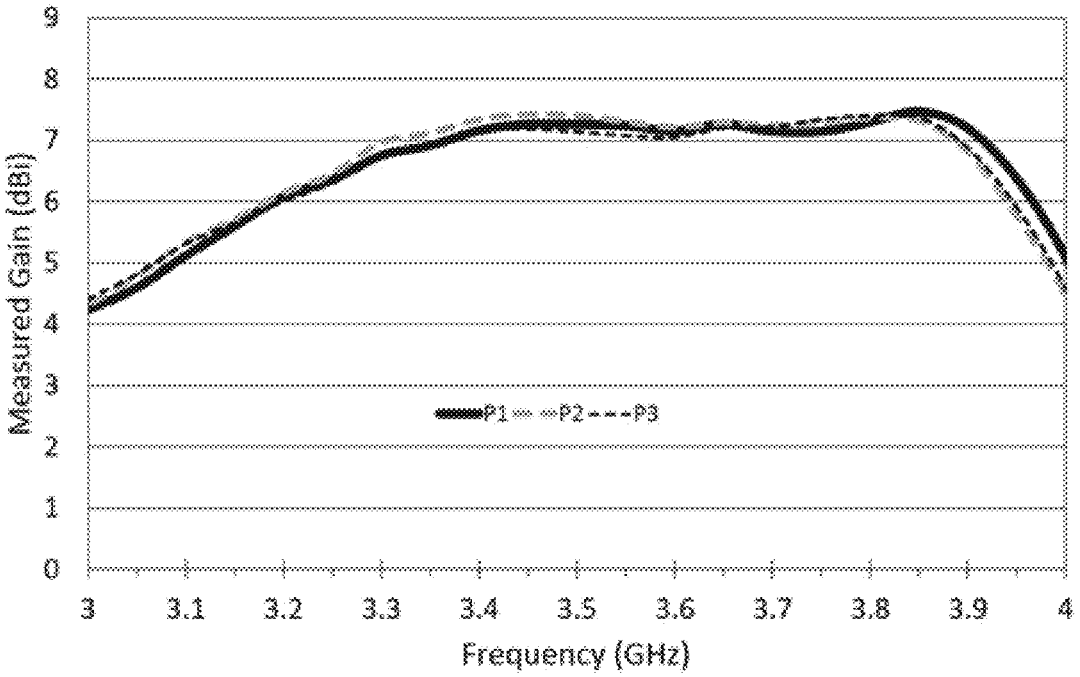

FIG. 16(*a*) shows a simulation schematic diagram of gain variation along with frequency with respect to different antenna ports for an exemplary embodiment of a compact wideband three-broadside-mode patch antenna. As can be seen in FIG. 16(*a*), the three curves are very close to each other. The antenna gain varies from 7.08 dBi to 7.97 dBi within the 10 dB impedance bandwidth.

FIG. 16(*b*) shows a measurement schematic diagram of gain variation of along with frequency with respect to different antenna ports for an exemplary embodiment of a compact wideband three-broadside-mode patch antenna. There is a little discrepancy between ports due to fabrication tolerance, but manufacturing accuracy can be improved by prototyping in a commercial workshop. In any event, when compared to FIG. 16(*a*), it can be seen that agreement between simulation and measurement results was demonstrated in this example.

Figure 17A:
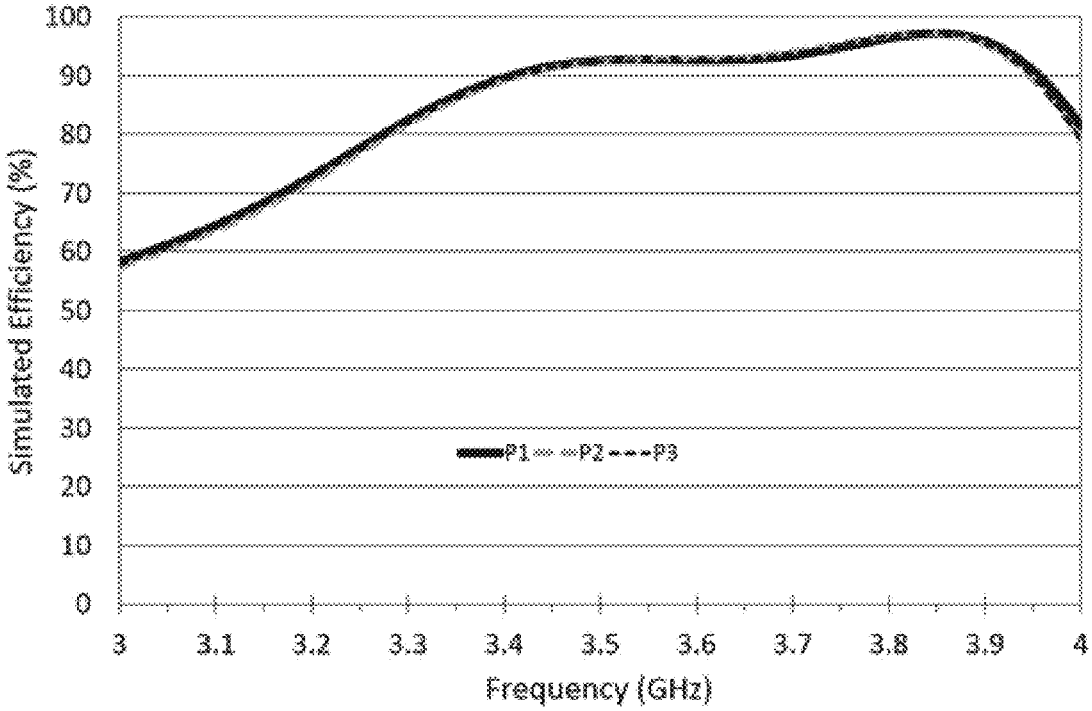
FIGS. 17(*a*)-17(*b*) show simulated and measured efficiency of an exemplary embodiment of a compact wideband three-mode patch antenna.
Figure 17B:
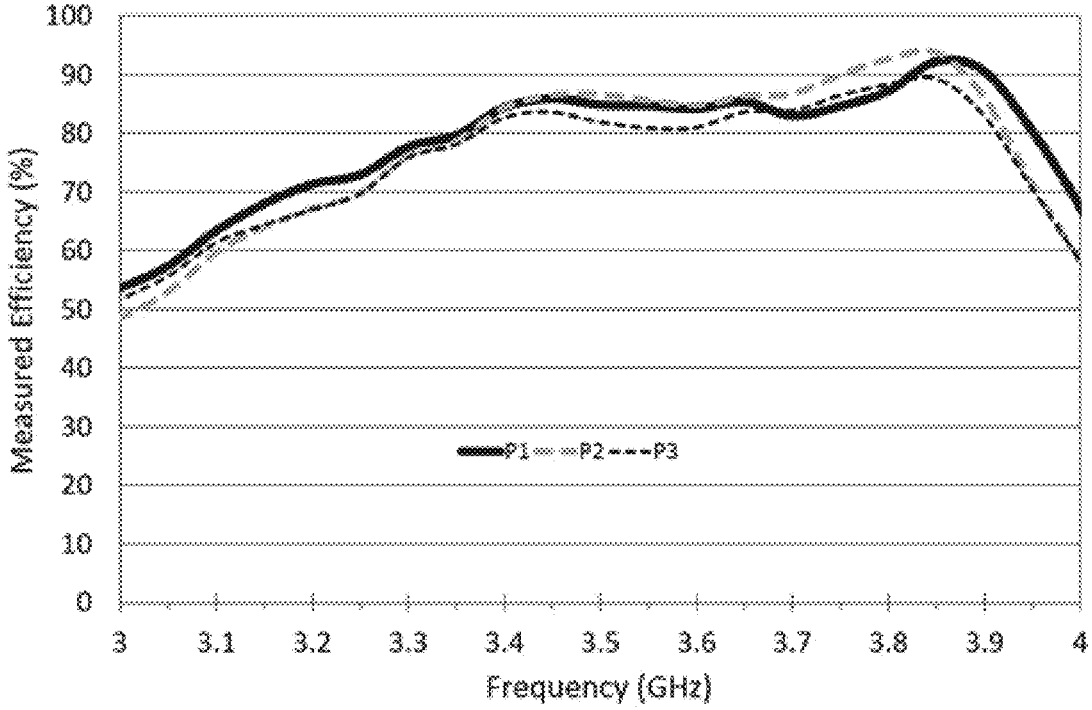

FIG. 17(*a*) shows a simulation schematic diagram of efficiency variation along with frequency with respect to different antenna ports for an exemplary embodiment of a compact wideband three-broadside-mode patch antenna. As can be seen in FIG. 17(*a*), the three curves are very close to each other. The total antenna efficiency varies from 81.7% to 97.5% within the 10 dB impedance bandwidth.

FIG. 17(*b*) shows a measurement schematic diagram of efficiency variation along with frequency with respect to different antenna ports for an exemplary embodiment of a compact wideband three-broadside-mode patch antenna. There is a little discrepancy between ports due to fabrication tolerance, but manufacturing accuracy can be improved by prototyping in a commercial workshop. In any event, when compared to FIG. 17(*a*), it can be seen that agreement between simulation and measurement results was demonstrated in this example.

Figure 18:
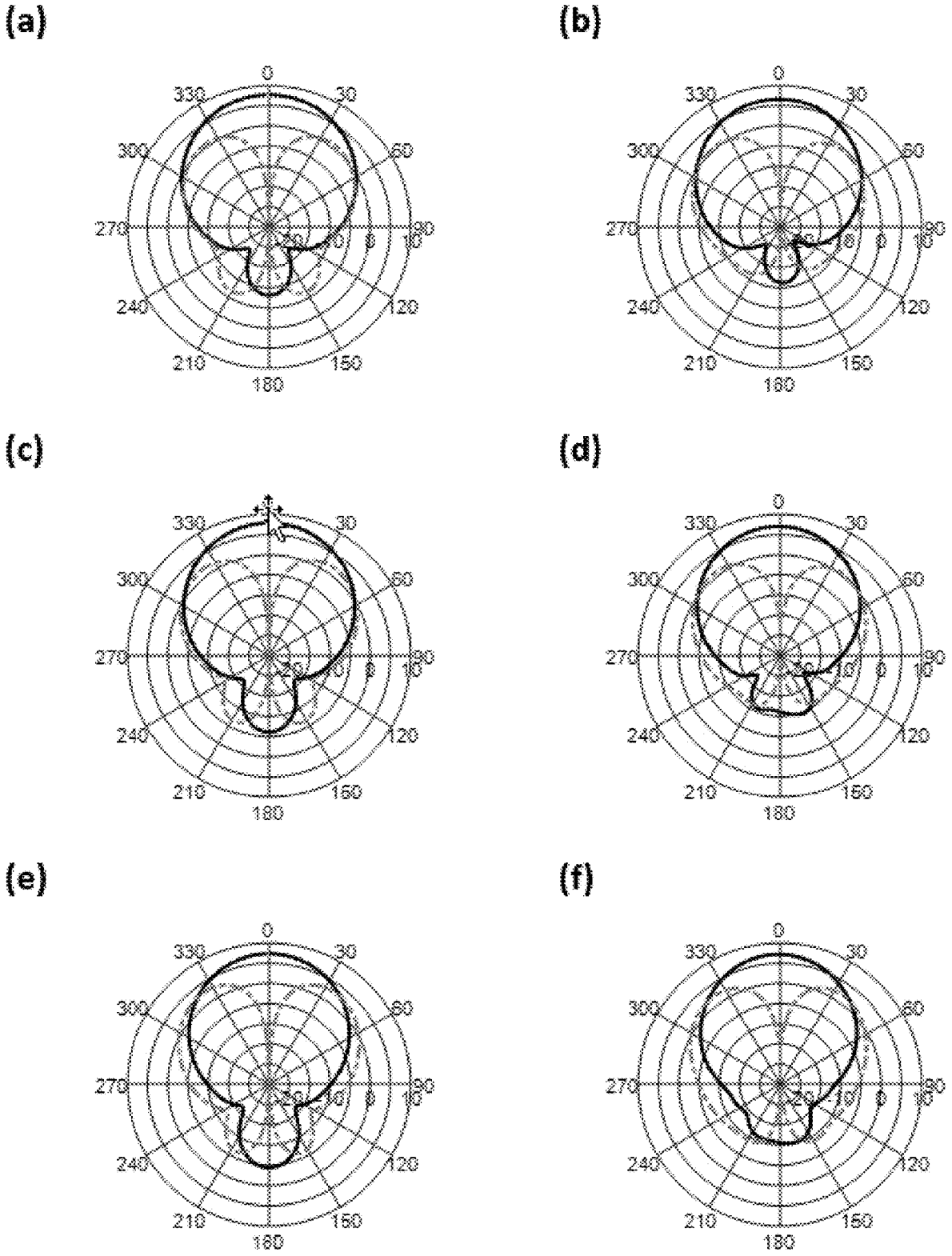
FIG. 18 shows simulated and measured radiation patterns with respect to a first port in the xz-plane at 3.4 GHz, 3.6 GHz and 3.8 GHz for an exemplary embodiment of a compact wideband three-broadside-mode patch antenna (with the second and third ports terminated with 50Ω loads during measurement)

FIG. 18 shows simulated and measured radiation patterns with respect to a first port in the xz-plane at 3.4 GHz, 3.6 GHz and 3.8 GHz for an exemplary embodiment of a compact wideband three-broadside-mode patch antenna (with the second and third ports terminated with 50Ω loads during measurement). Part (a) of FIG. 18 shows a simulated radiation pattern at 3.4 GHz; part (b) of FIG. 18 shows a measured radiation pattern at 3.4 GHz; part (c) of FIG. 18 shows a simulated radiation pattern at 3.6 GHz; part (d) of FIG. 18 shows a measured radiation pattern at 3.6 GHz part (e) of FIG. 18 shows a simulated radiation pattern at 3.8 GHz; and part (f) of FIG. 18 shows a measured radiation pattern at 3.8 GHz. The solid black and dashed grey lines correspond to E-phi and E-theta, respectively. As can be seen in FIG. 18, agreement between simulation and measurement results was demonstrated in this example. It will be appreciated that, if the second and third ports were simulated and measured, the radiation patterns for the second and third ports would be the same as depicted in FIG. 18 except rotated by +/−120 degrees about the z-axis due to the rotationally symmetric antenna geometry. The radiation patterns from all three ports point to the broadside direction, and the characteristics of broadside radiations are obtained and maintained over a wide frequency range.

Figure 19:
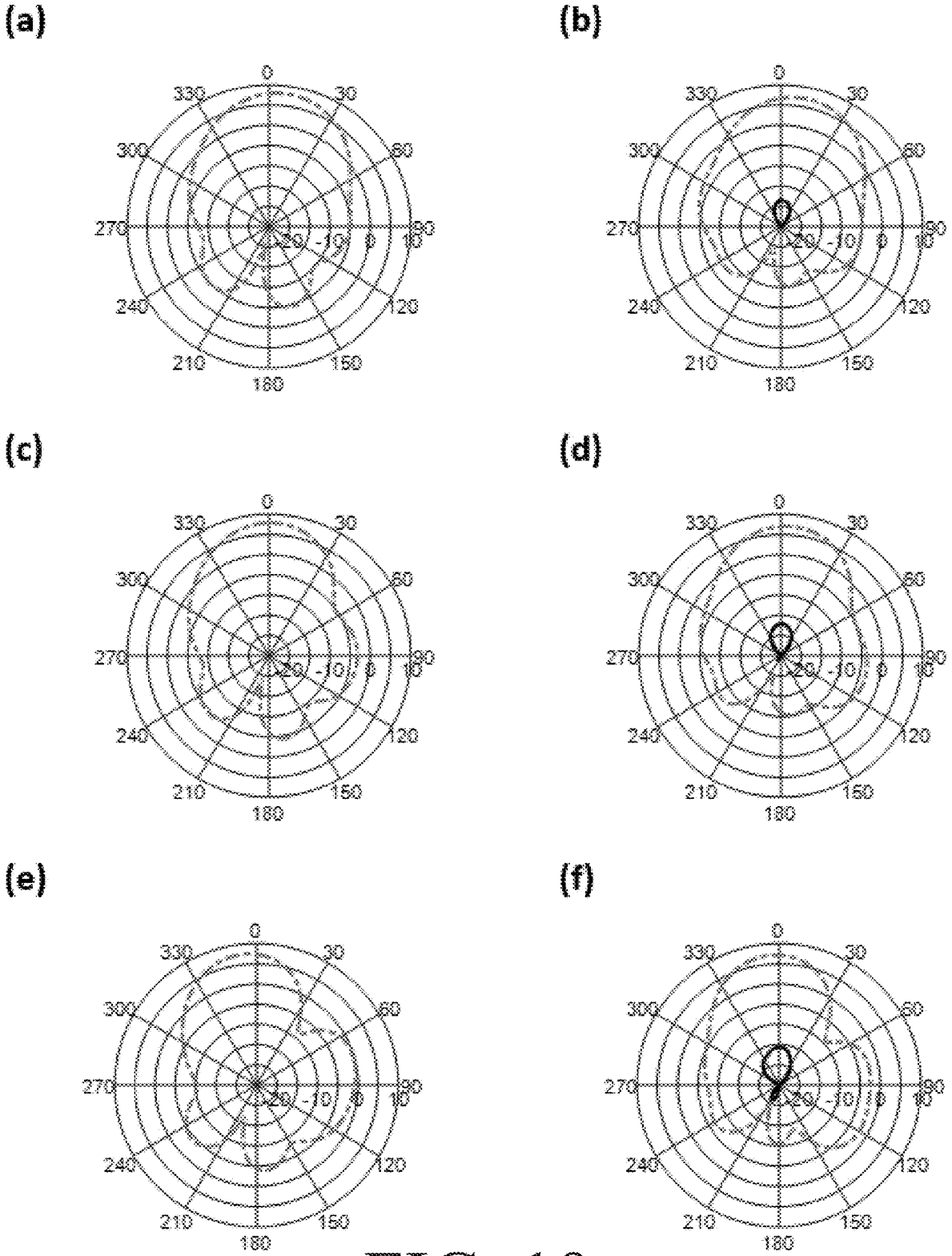
FIG. 19 shows simulated and measured radiation patterns with respect to a first port in the yz-plane at 3.4 GHz, 3.6 GHz and 3.8 GHz for an exemplary embodiment of a compact wideband three-broadside-mode patch antenna (with the second and third ports terminated with 50Ω loads during measurement)

FIG. 19 shows simulated and measured radiation patterns with respect to a first port in the yz-plane at 3.4 GHz, 3.6 GHz and 3.8 GHz for an exemplary embodiment of a compact wideband three-broadside-mode patch antenna (with the second and third ports terminated with 50Ω loads during measurement). Part (a) of FIG. 19 shows a simulated radiation pattern at 3.4 GHz; part (b) of FIG. 19 shows a measured radiation pattern at 3.4 GHz; part (c) of FIG. 19 shows a simulated radiation pattern at 3.6 GHz; part (d) of FIG. 19 shows a measured radiation pattern at 3.6 GHz; part (e) of FIG. 19 shows a simulated radiation pattern at 3.8 GHz; and part (f) of FIG. 19 shows a measured radiation pattern at 3.8 GHz. The solid black and dashed grey lines correspond to E-phi and E-theta, respectively. As can be seen in FIG. 19, agreement between simulation and measurement results was demonstrated in this example. It will be appreciated that, if the second and third ports were simulated and measured, the radiation patterns for the second and third ports would be the same as depicted in FIG. 19 except rotated by +/−120 degrees about the z-axis due to the rotationally symmetric antenna geometry. The radiation patterns from all three ports point to the broadside direction, and the characteristics of broadside radiations are obtained and maintained over a wide frequency range.

Figure 20:
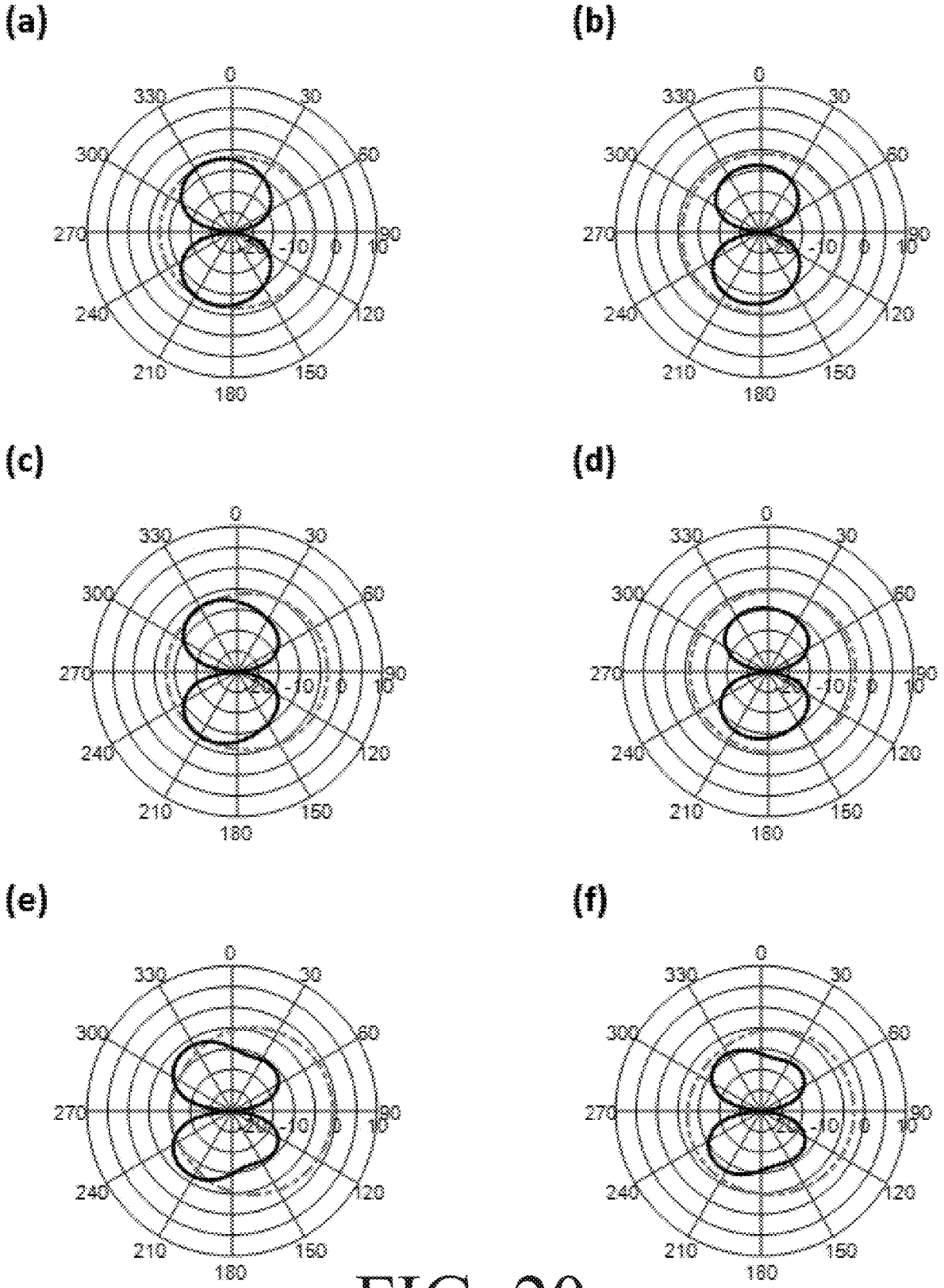
FIG. 20 shows simulated and measured radiation patterns with respect to a first port in the xy-plane at 3.4 GHz, 3.6 GHz and 3.8 GHz for an exemplary embodiment of a compact wideband three-broadside-mode patch antenna (with the second and third ports terminated with 50Ω loads during measurement)

FIG. 20 shows simulated and measured radiation patterns with respect to a first port in the xy-plane at 3.4 GHz, 3.6 GHz and 3.8 GHz for an exemplary embodiment of a compact wideband three-broadside-mode patch antenna (with the second and third ports terminated with 50Ω loads during measurement). Part (a) of FIG. 20 shows a simulated radiation pattern at 3.4 GHz; part (b) of FIG. 20 shows a measured radiation pattern at 3.4 GHz; part (c) of FIG. 20 shows a simulated radiation pattern at 3.6 GHz; part (d) of FIG. 20 shows a measured radiation pattern at 3.6 GHz; part (e) of FIG. 20 shows a simulated radiation pattern at 3.8 GHz; and part (f) of FIG. 20 shows a measured radiation pattern at 3.8 GHz. The solid black and dashed grey lines correspond to E-phi and E-theta, respectively. As can be seen in FIG. 20, agreement between simulation and measurement results was demonstrated in this example. It will be appreciated that, if the second and third ports were simulated and measured, the radiation patterns for the second and third ports would be the same as depicted in FIG. 20 except rotated by +/−120 degrees about the z-axis due to the rotationally symmetric antenna geometry.

Figure 21:
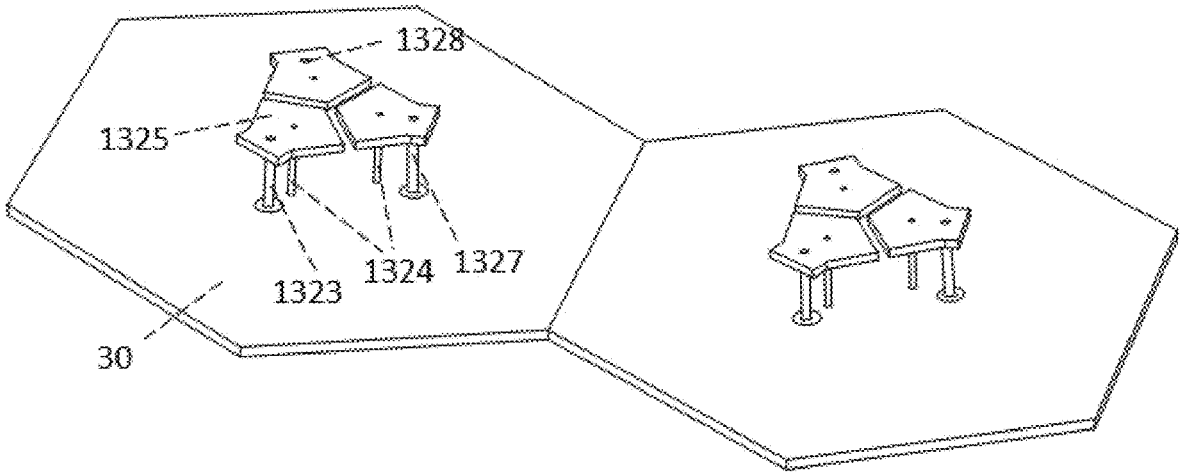
FIG. 21 shows two wideband antennas with hexagonal ground planes joined together according to an exemplary embodiment (including: (a) a first perspective view without the patch radiators, and (b) a second perspective view with the patch radiators)
Figure 21:
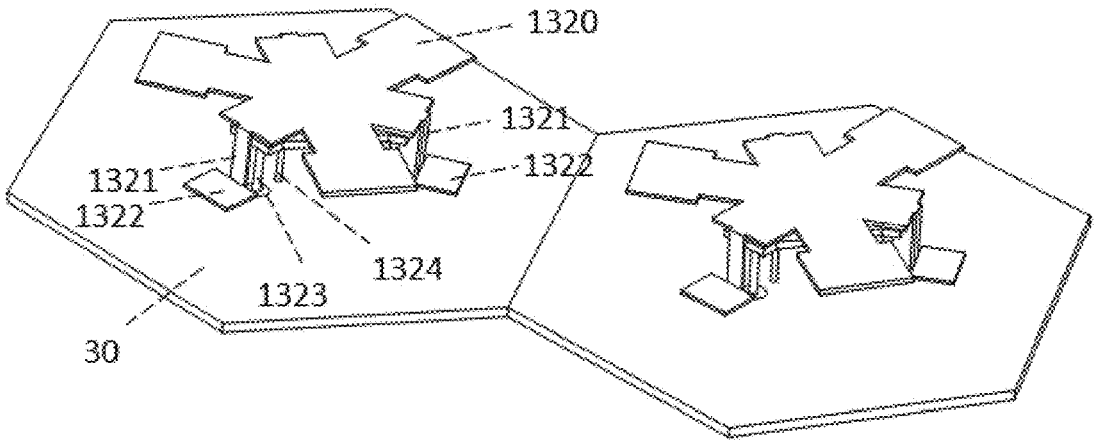

FIG. 21 shows two wideband antennas with hexagonal ground planes joined together according to an exemplary embodiment. Part (a) of FIG. 21 shows a first perspective view of the two wideband antennas without the patch radiators; and part (b) of FIG. 21 shows a second perspective view of the two wideband antennas with the patch radiators). It will be appreciated that each of the two wideband antennas depicted in FIG. 21 may have the structure, materials, and configuration depicted and discussed above with respect to FIGS. 13(*a*)-13(*b*), and with the ground plane 30 formed as a regular hexagon. Because the wideband antennas are rotationally symmetric about the z-axis by 120 degrees, the hexagonal ground plane allows for two (or more) antennas to be concatenated together. In an exemplary embodiment, for example as depicted in part (b) of FIG. 21, an unfolded branch of one antenna is arranged such that it points toward a folded branch of another antenna, which helps to minimize inter-element mutual coupling between adjacent antennas.

Figure 22:
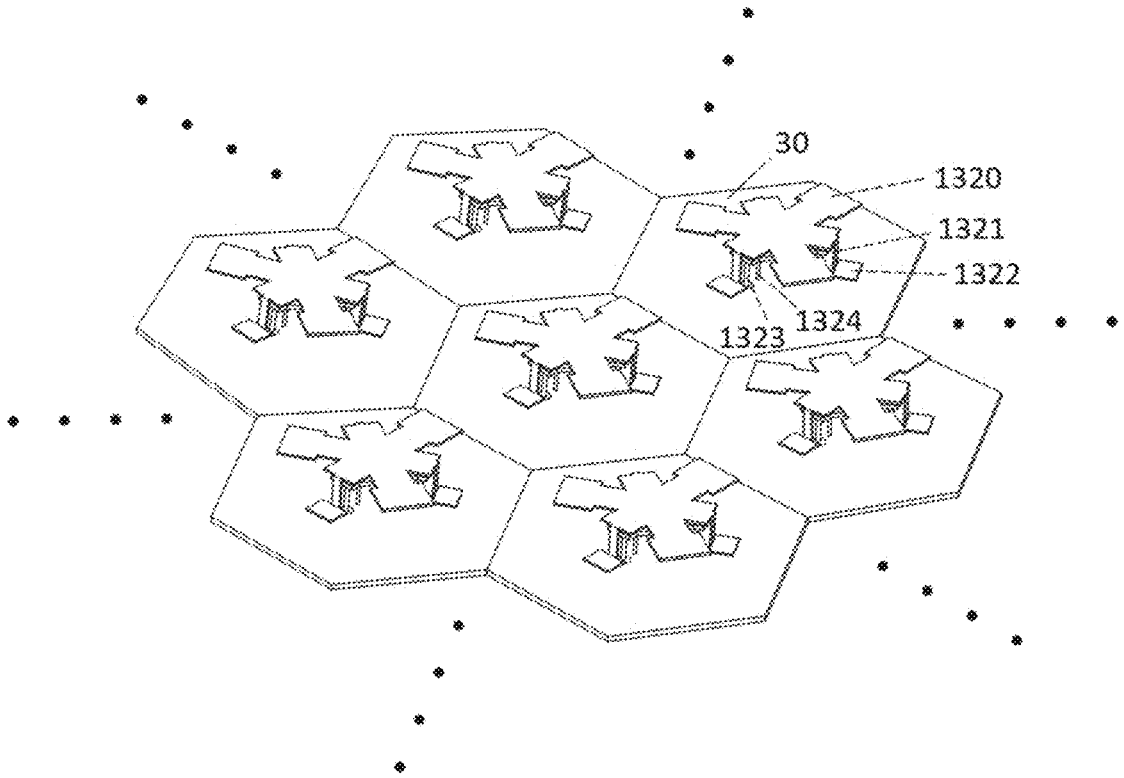
FIG. 22 shows a perspective view of seven (or more) wideband antennas with hexagonal ground planes joined together according to an exemplary embodiment.

FIG. 22 is an extension of FIG. 21 showing a perspective view of seven (or more) wideband antennas with hexagonal ground planes joined together, for example into a massive MIMO array, according to an exemplary embodiment. It will be appreciated that each of the wideband antennas depicted in FIG. 22 may have the structure, materials, and configuration depicted and discussed above with respect to FIGS. 13(*a*)-13(*b*), and with the ground plane 30 formed as a regular hexagon. In an exemplary embodiment, all unfolded branches of one antenna are arranged such that they point toward folded branches of adjacent antennas as illustrated in FIG. 22, which helps to minimize inter-element mutual coupling between adjacent antennas.

It will be appreciated that the number of antennas which may be concatenated in the manner shown in FIG. 22 is theoretically unlimited, and the massive MIMO array may include any number of antennas. The inter-element mutual coupling mainly depends on the inter-element spacing (the smaller the spacing, the higher the mutual coupling).

The array may be utilized in large intelligent surface (LIS) applications, and is easily integrated, for example, into the walls of a building.

Figure 23:
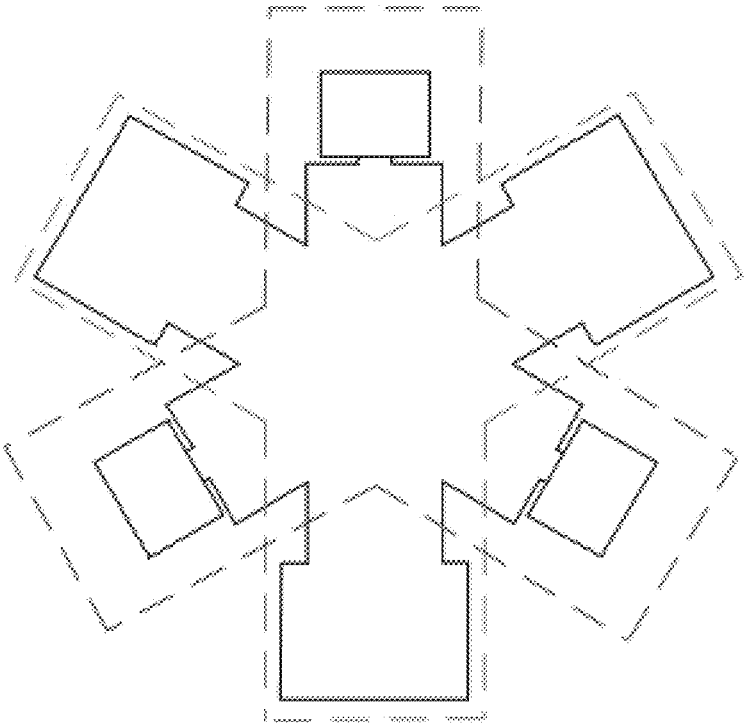
FIG. 23 shows a top view of the radiator of a compact wideband three-broadside-mode patch antenna according to an exemplary embodiment.

FIG. 23 shows a top view of the radiator of a compact wideband three-broadside-mode patch antenna according to an exemplary embodiment. As can be seen in FIG. 23, the shape of the radiator can be considered as being 2 superimposed Y-shape patches, wherein each Y-shape patch has a different set of dimensions.

In view of the foregoing discussion, it can be seen that exemplary embodiments of the invention further provide a compact wideband three-broadside-mode patch antenna. In an embodiment, the compact wideband three-broadside-mode patch antenna is able to achieve an impedance bandwidth of more than 19.7%, which is able to cover most 3 GHz ranges used in 5G communication systems. In an embodiment, the patch radiator of the antenna includes six branches, in which three are unfolded and three are folded towards ground plane. In an embodiment, the unfolded and folded branches are arranged alternatively, and this architecture assists in generating two nearby antenna resonances for wideband operation. In an embodiment, the folded structure of the patch reduces the overall projection antenna area, such that a patch with a largest dimension of $0.45\lambda_o$. (where $\lambda_o$ is the wavelength in air) can accommodate three antenna ports according to an embodiment of the invention. In an embodiment, an additional antenna port or 50% increment is achieved when compared to a conventional half-wavelength dual-polarized patch antenna counterpart. In an embodiment, low mutual coupling between three antenna ports can be achieved. In an embodiment, the capacitive feed of antenna port excitations cancels out certain probe inductance, resulting in better impedance matching. In an embodiment, the three mode radiations of the antenna are all pointing in the broadside direction. In an embodiment, the three mode radiations can be excited by three antenna ports simultaneously. In an embodiment, the three mode radiations are identical due to the rotationally symmetric antenna geometry (circular structure is included). In an embodiment, a single patch antenna is able to generate more than two broadside radiation patterns with low mutual coupling across 19.7% impedance bandwidth (at least). In an embodiment, the shape of the antenna structure is well fit with a hexagonal ground plane (e.g., based on having six branches or spokes). In an embodiment, multiple antennas can be concatenated together due to the hexagonal shape of the antenna ground plane. In an embodiment, the compact wideband three-mode patch antenna can be considered as a unit cell for building massive MIMO array. In an embodiment, the antenna is scalable to any number in the azimuth plane.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A three-broadside-mode patch antenna, comprising:

a rotationally symmetric radiator;

one or more patches, wherein the one or more patches are separated from the rotationally symmetric radiator by a dielectric and configured to capacitively feed the rotationally symmetric radiator; and three antenna probes, connected to the one or more patches, configured to simultaneously excite the one or more patches for capacitively feeding the rotationally symmetric radiator and generating three respective broadside radiation polarizations.

2. The three-broadside-mode patch antenna according to claim 1, wherein the rotationally symmetric radiator comprises a plurality of spokes.

3. The three-broadside-mode patch antenna according to claim 2, wherein alternating spokes of the plurality of spokes have a different size and/or a different shape.

4. The three-broadside-mode patch antenna according to claim 3, wherein the plurality of spokes comprises a first set of spokes and a second set of spokes, wherein each spoke of the first set of spokes extends horizontally outwards, and each spoke of the second set of spokes comprises a first horizontal portion, a vertical portion and a second horizontal portion.

5. The three-broadside-mode patch antenna according to claim 4, wherein the vertical portion is thinner than the first and second horizontal portions.

6. The three-broadside-mode patch antenna according to claim 1, wherein the rotationally symmetric radiator comprises six spokes interlaced in an arrangement in which a first plurality of spokes terminate at a first height and a second plurality of spokes terminate at a second height.

7. The three-broadside-mode patch antenna according to claim 1, wherein the rotationally symmetric radiator comprises six spokes, including three folded spokes and three unfolded spokes.

8. The three-broadside-mode patch antenna according to claim 1, wherein a largest dimension in a projection area of the three-broadside-mode patch antenna is approximately $0.48\lambda_o$, where $\lambda_o$ is the wavelength in air.

9. The three-broadside-mode patch antenna according to claim 1, wherein a 10 dB impedance bandwidth of the three-broadside-mode patch antenna is at least 19.7%.

10. The three-broadside-mode patch antenna according to claim 1, wherein the one or more patches comprise three identical patches to which the three antenna probes are connected.

11. The three-broadside-mode patch antenna according to claim 1, further comprising:

one or more shorting pins; and a ground plane;

wherein the one or more shorting pins connect the one or more patches to the ground plane.

12. The three-broadside-mode patch antenna according to claim 1, wherein the dielectric comprises an air gap.

13. The three-broadside-mode patch antenna according to claim 1, further comprising:

a hexagonal ground plane.

14. The three-broadside-mode patch antenna according to claim 1, wherein each of the three antenna probes corresponds to a respective antenna port.

15. A massive multiple-input multiple-output (MIMO) antenna, comprising:

a plurality of three-broadside-mode patch antenna cells concatenated together, wherein each of the plurality of three-broadside-mode patch antenna cells comprises:

a rotationally symmetric radiator;

one or more patches, wherein the one or more patches are separated from the rotationally symmetric radiator by a dielectric and configured to capacitively feed the rotationally symmetric radiator; and three antenna probes, connected to the one or more patches, configured to simultaneously excite the one or more patches for capacitively feeding the rotationally symmetric radiator and generating three respective broadside radiation polarizations.

16. The MIMO antenna according to claim 15, wherein the rotationally symmetric radiator comprises a plurality of spokes.

17. The MIMO antenna according to claim 16, wherein alternating spokes of the plurality of spokes have a different size and/or a different shape.

18. The MIMO antenna according to claim 17, wherein the plurality of spokes comprises a first set of spokes and a second set of spokes, wherein each spoke of the first set of spokes extends horizontally outwards, and each spoke of the second set of spokes comprises a first horizontal portion, a vertical portion and a second horizontal portion.

19. The MIMO antenna according to claim 15, wherein each of the plurality of three-broadside-mode patch antenna cells further comprises:

a hexagonal ground plane.

20. The MIMO antenna according to claim 15, further comprising:

a common ground plane for the plurality of three-broadside-mode patch antenna cells.

21. A six-broadside-mode patch antenna, comprising:

a rotationally symmetric radiator;

one or more patches, wherein the one or more patches are separated from the rotationally symmetric radiator by a dielectric and configured to capacitively feed the rotationally symmetric radiator; and six antenna probes, connected to the one or more patches, configured to simultaneously excite the one or more patches for capacitively feeding the rotationally symmetric radiator and generating six respective broadside radiation polarizations.

* * * * *